US010399832B2

(12) United States Patent
Hoffend, Jr. et al.

(10) Patent No.: US 10,399,832 B2
(45) Date of Patent: Sep. 3, 2019

(54) COMPACT HOIST ACCESSORIES AND COMBINATION SYSTEMS

(71) Applicant: Electronic Theatre Controls, Inc., Middleton, WI (US)

(72) Inventors: Donald Aloysius Hoffend, Jr., Alexandria, VA (US); Donald Aloysius Hoffend, III, Annandale, VA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 785 days.

(21) Appl. No.: 14/941,658

(22) Filed: Nov. 15, 2015

(65) Prior Publication Data

US 2017/0137266 A1 May 18, 2017

(51) Int. Cl.

| | |
|---|---|
| ***B66D 5/16*** | (2006.01) |
| ***B66D 1/28*** | (2006.01) |
| ***B66D 1/26*** | (2006.01) |
| ***B66D 1/39*** | (2006.01) |
| ***B66D 1/56*** | (2006.01) |
| ***A63J 1/02*** | (2006.01) |
| ***B66D 1/54*** | (2006.01) |

(52) U.S. Cl.

CPC ..... *B66D 5/16* (2013.01); *A63J 1/028* (2013.01); *B66D 1/26* (2013.01); *B66D 1/28* (2013.01); *B66D 1/39* (2013.01); *B66D 1/54* (2013.01); *B66D 1/56* (2013.01)

(58) Field of Classification Search

CPC .. A63J 1/028; B66D 1/26; B66D 1/28; B66D 1/39; B66D 1/56; B66D 1/58; B66D 5/16

See application file for complete search history.

(56) References Cited

U.S. PATENT DOCUMENTS

| | | | | |
|---|---|---|---|---|
| 1,549,736 A | | 8/1925 | McCormick | |
| 3,327,811 A | * | 6/1967 | Mastroberte | B66B 5/044 187/305 |
| 4,029,177 A | * | 6/1977 | Fiss | B66B 5/044 187/374 |

(Continued)

OTHER PUBLICATIONS

PCT/US2016/062005 International Search Report and Written Opinion of the International Searching Authority dated Feb. 24, 2017 (8 pages).

*Primary Examiner* — Emmanuel M Marcelo

(74) *Attorney, Agent, or Firm* — Michael Best & Friedrich LLP

(57) ABSTRACT

A hoist system having a drum primarily self-contained within a batten, for raising and lowering lighting, sound equipment, curtains and the like, often in a performance environment. The compact system is highly scalable to a variety of spaces and applications, including school and public theaters and concert halls, as well as some homes, private business, etc. The hoist system may be adapted with safety mechanisms including an overspeed detector, which may comprise a centrifugal detection mechanism coupled to an elongate member of the system; dampening means; a compact mechanism for trimming or adjusting an operative length of elongate member; stabilizing pipe shaft bearings; elongate member diverter pulley mechanisms load balancing termination points. Additional features include various alternative combination hoist implementations and orientations, and alternative incorporated attachment mechanisms for use with the hoist system.

20 Claims, 36 Drawing Sheets

(56) References Cited

U.S. PATENT DOCUMENTS

| | | | | | |
|---|---|---|---|---|---|
| 4,169,522 | A | * | 10/1979 | Highland | B61B 12/06 182/14 |
| 5,052,523 | A | * | 10/1991 | Ericson | B66B 5/044 187/350 |
| 5,090,666 | A | * | 2/1992 | May | B66D 1/7415 254/329 |
| 5,101,937 | A | * | 4/1992 | Burrell | B66B 5/185 187/350 |
| 5,217,091 | A | | 6/1993 | Shiina et al. | |
| 5,299,661 | A | * | 4/1994 | Pramanik | B66B 5/044 187/373 |
| 2012/0103732 | A1 | * | 5/2012 | Kwon | B66B 5/044 187/305 |
| 2013/0098711 | A1 | * | 4/2013 | Aguado | B66B 5/044 187/373 |
| 2018/0237262 | A1 | * | 8/2018 | van Slett | B66B 5/0087 |

* cited by examiner

COMPACT HOIST ACCESSORIES AND COMBINATION SYSTEMS

CROSS-REFERENCE TO RELATED APPLICATIONS

This application is related to co-pending U.S. application Ser. No. 13/725,831, filed Dec. 21, 2012; and U.S. application Ser. No. 14/133,652, filed Dec. 19, 2013.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

Field of the Invention

The invention relates generally to an apparatus, system and method for moving a load, and associated accessories. More specifically, the invention relates to a compact hoist system with potential applicability in a theater, concert hall or stage environment, for raising and lowering curtains, scenery, lights and the like, as well as in a variety of other home and business contexts, and related features including stabilizing pipe shaft bearings, elongate member diverter pulley mechanisms, load balancing termination points, overspeed breaking mechanisms, alternative combination hoist implementations and installation orientations, alternative incorporated attachment mechanisms, and elongate member trim and termination mechanisms, among other inventions.

Description of the Related Art

Conventional lift or hoist systems of a variety of types are known for use in theatrical or other performance environments. A typical system may include a large rectangular casing having therein a winch or other motor, a drive mechanism, a drum around which winds lifting or support cable, along with various controllers, sensors and safety mechanisms. Conventional hoist systems tend to be bulky, with asymmetrical enclosures and external battens, which may lead to a costly loss of space in cramped environments, complicated retrofit projects or, in cases of new construction, expensive custom designs.

The mechanics of a conventional hoist system may be fixed to a framing beam or other secure, elevated structure of the performance location. Elongate cables or other members emerge from the mechanics, potentially re-routed by pulleys and other features prior to descending, and are typically connected to a batten or other structure to which are connected items to be raised or lowered, such as lights, speakers, curtains, etc.

An alternative implementation has the elongate members fixed to the overhead structure, with the other end of the elongate members descending downward toward a hoist, where they are wound around a drum. The drum and mechanics of the hoist move upward and downward as the drum turns, along with the items to be raised and lowered, which commonly are connected to a batten attached to a body of the hoist.

In another alternative implementation, a self-contained, self-climbing hoist system having a motor, and a drum around which winds one or more lengths of cable, rope or other elongate member, is provided for lifting and lowering at least a portion of the system, thereby also lifting attached objects, with respect to a fixed support.

Braking mechanisms are known for use with such hoist systems and others, but often suffer from various drawbacks, including being excessively weighty, complex, and/or expensive. Others may cause a braking effect that is overly abrupt, which may lead to damage to the hoist or an associated load, or damage or failure of the braking mechanism itself. Still others may be applied to a location within a system such that they protect only against certain conditions occurring at certain locations or components within the system, while failing to protect against others.

Conventional hoist systems may also lack a certain versatility in a number of contexts. Efforts are made herein to provide optional additional features and implementations.

SUMMARY OF THE INVENTION

The invention relates to a hoist system, method and apparatus. In one embodiment, the invention includes a hoist or lift contained within a compact structure. In a more specific embodiment, the invention seeks to offer a compact and highly adaptable self-climbing hoist system, at least some of the components of which are confined within an enclosure of the same. In a still more specific embodiment, the enclosure may be a tube or batten to which are attached items to be raised and/or lowered. The design of the invention is such that it may be scalable to a wide variety of sizes and applications.

In one aspect, a hoist in accordance with an embodiment of the invention includes a pipe batten or other object, for raising and lowering items under control of a motor-driven drum having wound around it an elongate member fixed to an elevated support, thereby raising and lowering the hoist upon rotation of the drum, wherein the drum is disposed within the pipe batten or other object. Depending upon a particular application, this arrangement may permit use of a hoist that is lighter, occupies less space and/or requires a motor having less torque, among other features, as compared to other hoist designs.

In another aspect, a batten in accordance with the invention may further act as a structure for supporting desired features, including light and sound fixtures, sources of electrical power, etc.

In another aspect of the invention, mechanisms are provided for fine tuning an operative length of an elongate member, permitting adjustments for leveling or otherwise modifying a hoist system setup, at installation or at other appropriate times.

In another aspect, the invention relates to an apparatus, system and method for applying a stopping force to a moving object, including a system or mechanism for arresting the movement of an elongate member, such as a wire rope or other load-bearing line. Such a braking mechanism may be activated upon detection of an overspeed condition, with potential applicability to hoists and other such machines for lifting or otherwise moving a load. In this aspect, the invention seeks to offer a relatively simple and inexpensive, mechanical implementation of the invention. The mechanism for detecting an overspeed condition may be a centrifugal detection mechanism.

In one implementation, the invention comprises an overspeed brake assembly for implementation with a system having a traveling elongate member, such as a wire rope, that may under certain conditions travel at a rate greater than desired for any of a variety of possible reasons. The greater than desired rate under applicable circumstances is herein termed an overspeed condition. The brake assembly may therefore include a means for detecting a rate of travel of an elongate member, and means to determine whether that rate meets or exceeds a defined overspeed condition, where that condition may be defined precisely or on an estimated basis. The brake assembly may further include a means to, in response to such a detection and/or determination, slow or arrest completely, at variable degrees of deceleration, the movement of that elongate member.

In a hoist environment, it may be desirable to provide a mechanism to protect against failure of any hoist component, including failure of a motor and/or gear box, the stripping of a drum key, a breakdown of the drum itself, etc. A mechanism placed within the motor housing may not protect against failure related to the drum, for example.

In another aspect, the invention relates to a mechanism for use with an elongate member such as a cable or wire rope, for enabling adjustment or trimming of the operative length of the member. Mechanisms are provided for fine tuning or trimming an operative length of an elongate member, permitting adjustments for leveling or otherwise modifying a hoist system setup, at installation or at other appropriate times. The design of the inventions is such that they may be applicable to a wide variety of applications.

In another aspect of the invention, stabilizing pipe shaft bearings are provided to stabilize a drum and associated shafts and related features, during rotation during use of the hoist In another aspect of the invention, an elongate member diverter pulley mechanism is provided for increased versatility, permitting a hoist to be adapted to environments where overhead elongate member attachments points are limited in their locations, such that elongate members may maintain a substantially vertical orientation between the hoist and overhead support.

In another aspect of the invention, load balancing termination points are provide for increased safety, and to substantially equalize loads experienced by paired or multiple elongate members.

In another aspect of the invention, alternative combination hoist implementations, including hoists incorporated into truss arrangements, for applicability in additional environments where additional support members or plural battens may be desirable.

In another aspect of the invention, alternative installation orientations are proposed, such as an inverted compact hoist in accordance with the invention, potentially offering still further versatility of the inventions disclosed herein.

In another aspect of the invention, alternative incorporated attachment mechanisms are disclosed, which may be implemented during a manufacturing process, including by extrusion. Such mechanisms may facilitate attachment of a broader variety of implements during use in certain environments.

Other inventive aspects will be apparent from an analysis of the disclosure herein.

DETAILED DESCRIPTION OF THE INVENTION

In the following detailed description of the invention, reference is made to the figures, which illustrate specific, exemplary embodiments of the invention. It should be understood that varied or additional embodiments having different structures or methods of operation might be used without departing from the scope and spirit of the disclosure. For example, although the inventions herein are described primarily with reference to a hoist environment, numerous other implementations are contemplated.

In one implementation, the invention comprises a self-contained, self-climbing hoist system, having a motor, and a drum around which winds one or more lengths of cable, rope or other elongate member, for lifting and lowering at least a portion of the system, thereby also lifting attached objects, with respect to a fixed support. Depending upon an intended application, the motor and drum may be partially or fully contained within a batten or other enclosure. A batten often takes the form of a pipe or tube batten, though other forms are contemplated. For example, the use of a length of material having a square or other polygonal, elliptical, or any other cross-section might be beneficial, depending upon a particular application. Articles to be raised and lowered may be attached to the pipe directly, or indirectly, such as through a laddered arrangement of one or more additional pipes or other support mechanism, depending upon a particular application.

Figure 1:
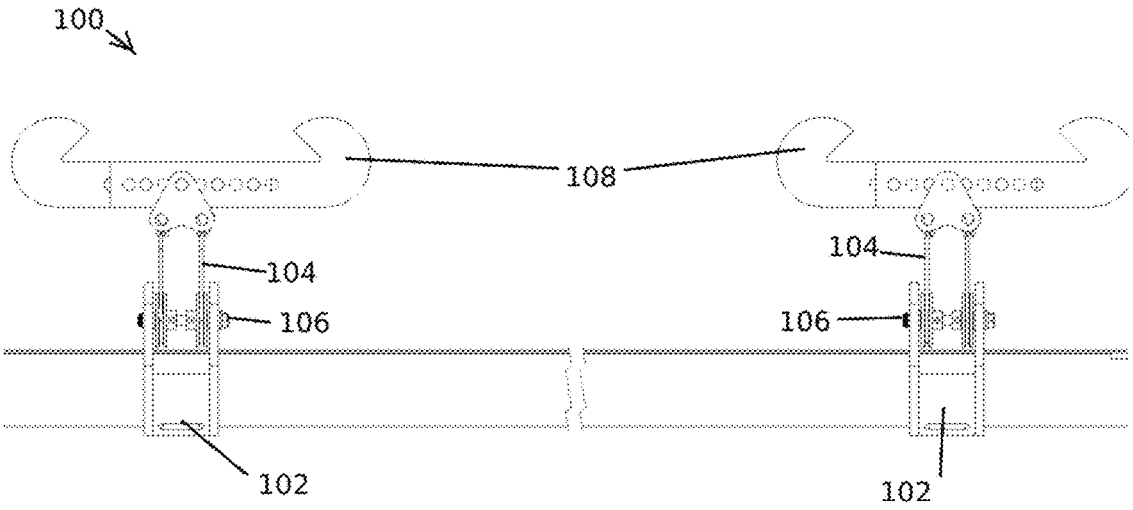
FIG. 1 is a partial perspective view of an embodiment of a hoist system in accordance with the invention, the view being truncated for illustration purposes.

An embodiment of the invention is illustrated by FIG. 1 as a hoist 100. In this embodiment, the hoist 100 is self-contained within a tube or pipe, here a batten 102. The size and/or shape of the batten 102, its method of manufacture, etc., may vary significantly depending upon a particular application. In one embodiment, the batten 102 is formed as an extrusion in a desired shape (i.e., cross section, generally, through the use of a die). The shape may be chosen for ease of attachment of a wide variety of attachments (temporary or permanent), including light fixtures, sound elements, power outlets, etc.

The batten 102 as illustrated houses a motor and drum. Powered by the motor, the drum rotates about an axis that may be substantially shared by the batten 102, spooling or winding an elongate member 104 around the drum. As explained in greater detail herein, the drum may, during rotation, further move in a direction parallel to its center axis and at a predetermined distance/rate with respect to the rotation, such that as the elongate member 104 encircles the drum, successive lengths thereof lay in direct contact with the drum, rather than the elongate member piling 104 atop itself.

The drum may further be adapted with grooves or ridges for receiving the successive lengths of the elongate member 104, such that an outer diameter of the combination of the drum and wound elongate member is 1) greater than an outer diameter of the drum itself by an amount less than a diameter of the elongate member, or 2) not increased at all by the elongate member 104, in a case that the elongate member 104 fits entirely within the grooves. In an application where elongate members 104 fit fully within grooves of the drum, a batten 102 may be chosen such that, as elongate members 104 encircle the drum, the batten 102 prevents the elongate members 104 from leaving the grooves, even in the event that tension on the elongate members 104 is not be fully maintained. In either case, this feature may enable a more compact design, e.g., the use of a tube of a relatively smaller diameter, depending upon a particular application.

An elongate member may be connected to a drum and adapted to wind thereabout in a variety of ways. In one embodiment, a drum is adapted to receive two elongate members 104 (or two lengths of a continuous elongate member 104 as further discussed herein) at an end. Thus, the grooves may be formed as a double-lead helical groove, i.e., double-start drums may be used. Three (triple)- or further multiple-lead arrangements are contemplated as well, depending upon a particular application. A multi-lead arrangement may increase strength and reliability over a single lead, provide redundancy as a safety measure, decrease noise and/or component wear, etc. For example, instead of an arrangement having two 3/32" leads, a single 1/8" lead, three 1/16" leads, etc., might be substituted, depending on needs. Although the wire ropes may be in close proximity, they do not cross over each other as they wind onto the drum. This may extend the life of a wire rope on average, avoiding the additional physical stresses that may occur through the piling of the rope, crossing over, etc.

As further described herein, a batten and drum may cooperate in a variety of ways. In one embodiment, a drum is entirely encompassed by a batten having the same shape as the drum, with the batten having an internal diameter (and circumference) only slightly larger that an external diameter (and circumference) of the drum. In certain applications, the difference may be on the order of a few thousandths of an inch, for example. The design parameters of the drum and batten may alternatively be such that the two surfaces are intended to remain in slight contact during operation, where the surface of the drum may be interrupted by grooves for receiving a wire rope. A depth of grooves in the drum may likewise be on the order of a few thousandths of an inch deeper than a diameter of the wire ropes.

In such an embodiment and others, materials for the batten and drum may be chosen accordingly. For example, a drum may be formed from a glass-filled nylon or other low-friction material with respect to a steel batten, among a number of other contemplated materials pairs. Alternative embodiments incorporate a spacer, bearing or other means for facilitating rotation of a drum within a batten, while maintaining some separation between the two. Such an arrangement may be useful in particular in hoists of greater length. FIGS. 7B-D and accompanying description are exemplary of an embodiment where space is maintained between a drum and batten.

Other factors contributing to a chosen tube diameter might include the nature of the cable or other elongate member. Winding a cable upon a small-diameter drum might degrade the cable over time, due to physical stresses within the strands or other material of which it is formed, imparted when the cable is over-flexed upon being wound. The use of a larger diameter drum might lessen these stresses, depending upon the relative diameters involved, the nature of the elongate member, etc.

In many applications, it is desirable to attach a hoist to a fixed, elevated structure. As shown in the exemplary embodiment of FIG. 1, the elongate member 104 emerges from the batten 102 through an opening, and may be used to couple the hoist assembly 100 directly or indirectly to an overhead structure or other support. Specifically, the elongate member 104 in FIG. 1 passes through a double sheave assembly 106, and is connected to a beam clamp 108 by any of a variety of means, as further described herein. The beam clamp 108 may be attached as desired to an elevated structure, such as an overhead beam in a concert hall or theater setting, among numerous other potential applications. Other means of installing a hoist assembly for use are contemplated, as would be understood by one skilled in the art.

The elongate member 104 may be fabric rope, wire rope or cable, among others. In one embodiment, four approximately 0.28 (3/32") inch wire ropes are used, though countless variations are contemplated, depending upon a variety of factors. In another embodiment, approximately 0.28 (3/32") inch wire ropes are attached at a separation of 1.125 (1 1/8) inch and wound at a 1/4 inch pitch (i.e., 4 grooves per rope per inch, i.e., 8 grooves per inch for a dual-rope, double-start drum). Single-rope hoists are contemplated as well, as for lighter-duty applications. Larger diameter or more numerous ropes, with the same or larger diameter drums, may be used for heavier duty applications.

As illustrated by FIG. 1, an elongate member 104 may be comprised of multiple (as shown, 2) strands of rope. In one embodiment, a single strand of elongate member 104 is connected at both ends to a beam clamp 108 or other means of attachment, while a body of the member 104 passes unbroken through the double sheave assembly 106 or other suitable means of attachment to the batten 102. This continuous U-shaped length of elongate member 104 may further be fitted with, for example, a compression sleeve (see FIG. 6), such that if one of the two (in this embodiment) substantially parallel lengths of member 104 breaks, the other does not pull through the assembly 106, and maintains its support of the hoist assembly 100. A compression sleeve may likewise be used to couple the ends of two separate elongate members 104 in an embodiment where two strands are used, or in a single-strand embodiment in which the continuous end is disposed within or near the beam clamp 108.

Figure 2:
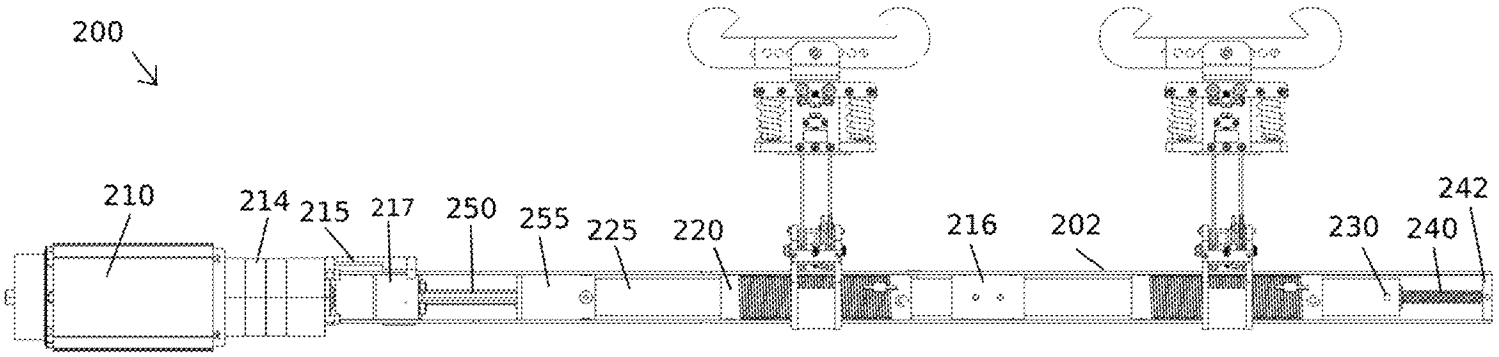
FIG. 2 is a perspective view of an embodiment of the internal mechanics of a hoist system in accordance with the invention.

FIG. 2 illustrates components of an embodiment of a hoist system 200 that may be internal to an enclosure or tube, for example a batten 102 as in FIG. 1 or a pipe batten 202 (illustrated transparently except for an outer periphery) as in FIG. 2, in accordance with the invention. Depending upon a particular application, an internal mechanism of the hoist system 200 might include a wide range of components, for example a motor 210, a gearbox 214, a gear mount to pipe batten coupling 215, a motor shaft to spline shaft coupling 217, a shaft coupling 216, a drum 220, a drum shaft or axle 225, a nut collar 230 fixed within the drum 220, an acme screw 240, a spline outer race housing 255, and a spline shaft 250 (see also FIG. 3 and description). In one embodiment, a motor 210 is coupled to and drives a drum 220 via a spline shaft 250, through which the motor 210 is able to impart a rotational force while allowing the drum 220 to slide, within a predetermined space, along the spline shaft 250. The spline shaft 250 might further be connected to the acme screw 240 via the drum axle 225.

In operation, these components may share a center axis, or various components may be offset as desired, with certain components potentially disposed outside of the tube, depending upon constraints including space, lift capacity required, etc. For example, it might be desirable due to space constraints that the motor be disposed in an offset position, parallel to and coupled to the drum 220 using gears or other suitable means, such that a length of the tube and/or overall apparatus might be lessened.

Figure 3:
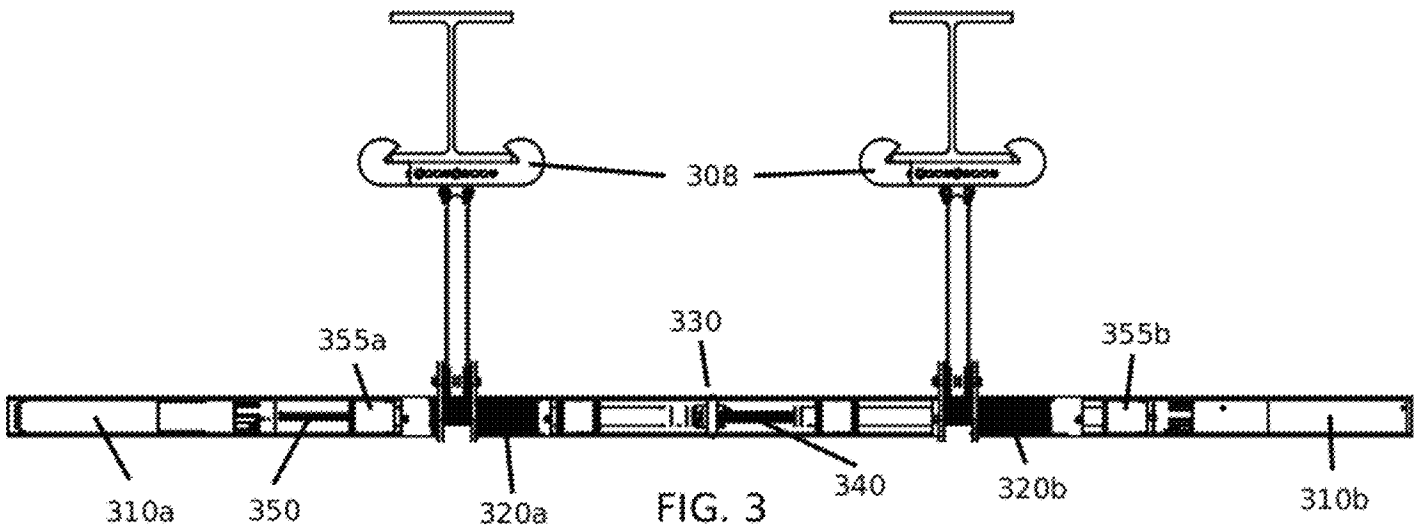
FIG. 3 is a perspective view of a dual-motor embodiment of a hoist system in accordance with the invention.

In one embodiment in accordance with the invention, as illustrated by FIG. 3, a hoist system 300 includes two motors 310*a* and 310*b* for driving two drums 320*a* and 320*b* disposed between the two motors 310*a* and 310*b*, one disposed at each approximate end of the associated enclosure, which may be a box, case, etc., here assumed for purposes of illustration to be a batten or other tube-like structure. Alternatively, the motors 310*a* and 310*b* or a single dual-drive motor might be disposed in an approximate center along a length of batten, or offset and having a nut collar or analogous feature at an approximate center, for driving the drums 320*a* and 320*b* positioned outwardly from the center, depending upon a particular application.

An operation of an implementation of a hoist system in accordance with the invention is described herein in the context of a dual-motor embodiment, with the associated concepts applicable as well to a single-motor embodiment, in accordance with the skill in the art. In another embodiment, a single motor, which might need to be of increased power in certain applications, is disposed at one end of a pipe or other enclosure, to drive one (1) or more drums about an acme screw fixed at the second end. For example, in a large venue application, e.g., an airplane hangar or terminal, a hoist of 300 or more feet might be needed, in which case it may be desirable to chain 15, 30 or more drums together. The invention is in that sense and others scalable and adaptable to a wide variety of potential implementations.

As described herein, the hoist system 300 might be designed such that, upon operation of the motors 310*a* and 310*b*, an approximately horizontal (assuming a normal operating position) translation of the drums 320*a* and 320*b* occurs.

In one embodiment, casings of the motors 310*a* and 310*b* and a nut collar 330 are fixed with respect to the tube, while rotors of the motors 310*a* and 310*b*, the drums 320*a* and 320*b*, an acme screw 340 and a spline shaft 350 are fixed with respect to each other, and turn within the tube. In addition to rotating within the tube, the drums 320*a* and 320*b* might be adapted for lateral (generally horizontal, assuming a normal operating position) movement along the spline shaft 350 by virtue of a pair (in a dual motor environment) of sliding couplers, herein spline couplers 355*a* and 355*b*, rotationally coupling each of the drums 320*a* and 320*b* to the spline shaft 350, i.e. transferring the driving force thereto, while allowing the drums 320*a* and 320*b* to respectively slide along the spline shaft 350 upon rotation, as described herein.

For example, an assembly of the two drums 320*a* and 320*b* and an acme screw 340 connecting them might be disposed in relation to the nut collar 330 such that upon rotation the two drums 320*a* and 320*b* move in unison along spline shaft 350, either toward one motor 310*a* or the other motor 310*b*, depending upon a direction of rotation. For example, the fixed-position nut collar 330 might be threaded to mate with threads of the acme screw 340, thereby imparting a generally horizontal force upon rotation of the acme screw 340 with respect to the respectively fixed nut collar 330. The resulting horizontal translation allows elongate members entering a fixed cutout in the tube to wrap around the drums 320*a* and 320*b* as the drums 320*a* and 320*b* rotate. Alternative arrangements leading to a similar result are possible as well.

In an alternative embodiment, the drums 320*a* and 320*b* move inward toward each other or outward away from each other, depending upon a direction of rotation of the motors 310*a* and 310*b*. Multiple nut collars 330 might be used or, as another example, one shaft might be threaded internally within another, etc., thus pulling the shafts inward. A relative direction of rotation of drums 320*a* and 320*b* is variable as well. For example, whether under control of a single or multiple motors 310*a* and 310*b*, the drums 320*a* and 320*b* might rotate in the same or opposite directions, either consistent with the directions of rotation of the motors 310*a* and 310*b* or, as in a single-motor embodiment, through the use of differentials to switch a direction of rotation inline. In one embodiment, depending upon an angle of exit of an elongate member from a batten, multiple such exits at the same angle along an outer periphery (e.g., circumference) of a batten (as might be the case when using drums that rotate in unison) might naturally lead to a torque being imparted on the batten. Utilizing drums rotating in opposite directions, with corresponding rope exits being on opposite sides (for example, at 10 o'clock and 2 o'clock, or 9 o'clock and 3 o'clock positions, about a cross-sectional periphery of a batten) of the batten, might beneficially lessen or eliminate (by counteraction) a collective torque on the batten.

Figure 4:
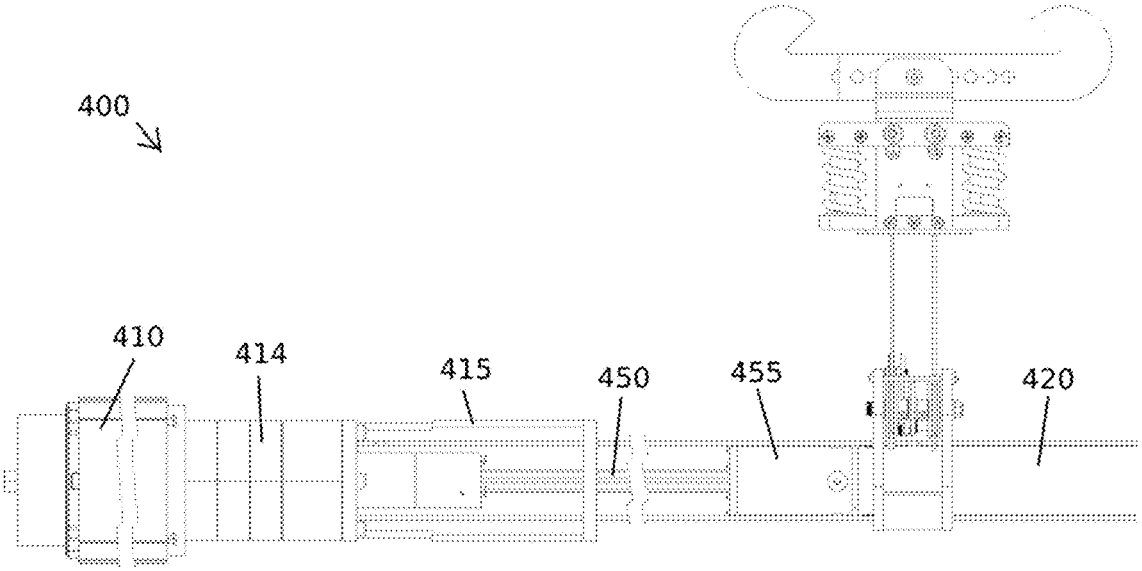
FIG. 4 is a perspective view of an embodiment of the internal mechanics of a hoist system in accordance with the invention.

As noted herein, an embodiment of a hoist 400 is contemplated in which a driving source, such as a motor 410, is disposed outside of a pipe 402, as illustrated by FIG. 4. The motor 410 in this embodiment is coupled via a motor drive shaft to a grooved or keyed drive shaft such as a spline shaft 450, through an optional gear box 414 and pipe batten-to-gearbox coupling 415. A gear box 414 might allow use of a motor 410 having less horsepower or lower torque, which may be a tradeoff for higher revolutions-per-minute (RPM) to achieve a comparable lifting action (speed, maximum load, etc.). Pipe batten-to-gearbox coupling 415 connects and prevents respective motion between the pipe 402 and the gearbox 414.

Figure 5:
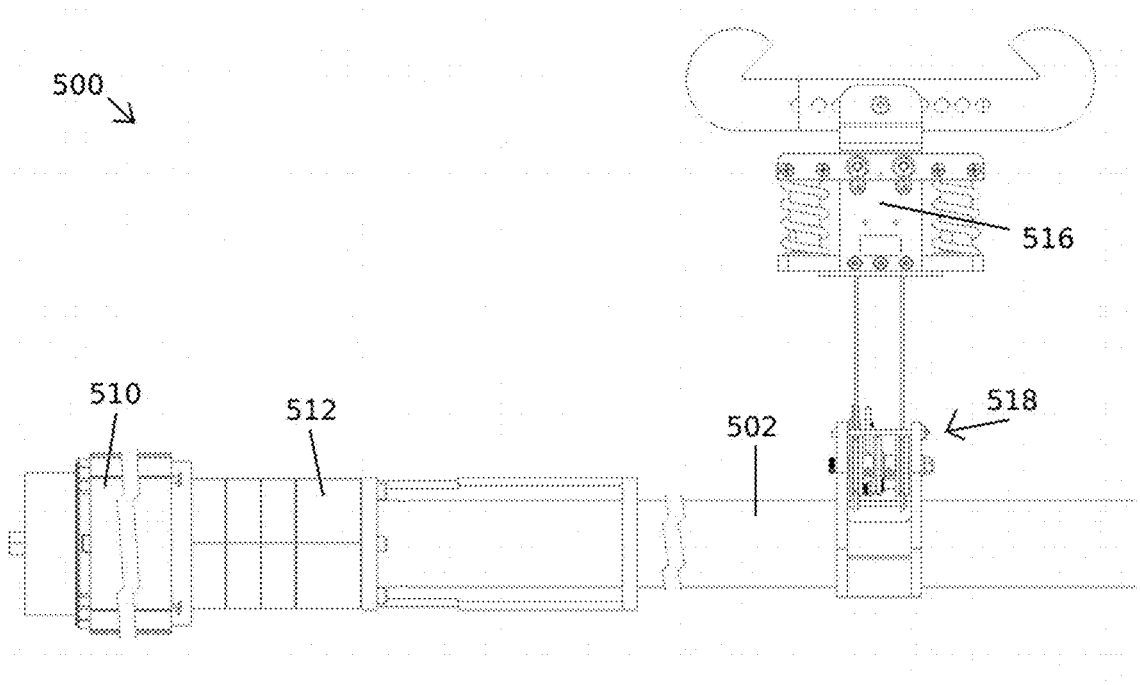
FIG. 5 is a detailed perspective view of an embodiment of a mechanism for connecting a batten to an overhead support in accordance with the invention.

A pipe batten 502, the position of which may be seen in FIG. 5, has been rendered transparent in FIG. 4 to better illustrate internal features such as a drum 420, a spline shaft 450 and a spline outer race to drum shaft coupling 455. In this embodiment, the spline outer race to drum shaft coupling 455 couples the spline shaft 450 to the drum 420, such that as the spline shaft 450 rotates under the power of the motor 410, the drum 420 translates in a direction parallel to a center axis (e.g., of rotation) of the spline shaft 450 (and in this embodiment, an axis of the motor 410). It is also contemplated that an axis of the motor 410 be offset from an axis of the spline shaft 450 if desired, such as to accommodate for space limitations.

It may further be seen in connection with FIGS. 4 and 5, as further described herein, that a batten 502 may be chosen to be only slightly larger than an outer surface (i.e., the lands of any grooves) of the drum 420. This may have the effect of, as wire ropes enter the batten 502 to be wound upon the drum 420, physically maintaining the wire ropes within the grooves around nearly an entire circumference of the drum 420 (in one embodiment, on the order of 340 degrees of the circumference).

FIG. 5 generally represents the view of FIG. 4 as a hoist system 500 having a motor 510 and a gearbox 512, without the transparency of the batten 502. In addition to the features described in the context of particular embodiments of the invention, it is contemplated that the features be variously used in other applications, and additional features are contemplated as well, including an overload sensor 518 and slack line detector 558, described in greater detail with respect to FIGS. 8 and 9, respectively.

Figure 6A:
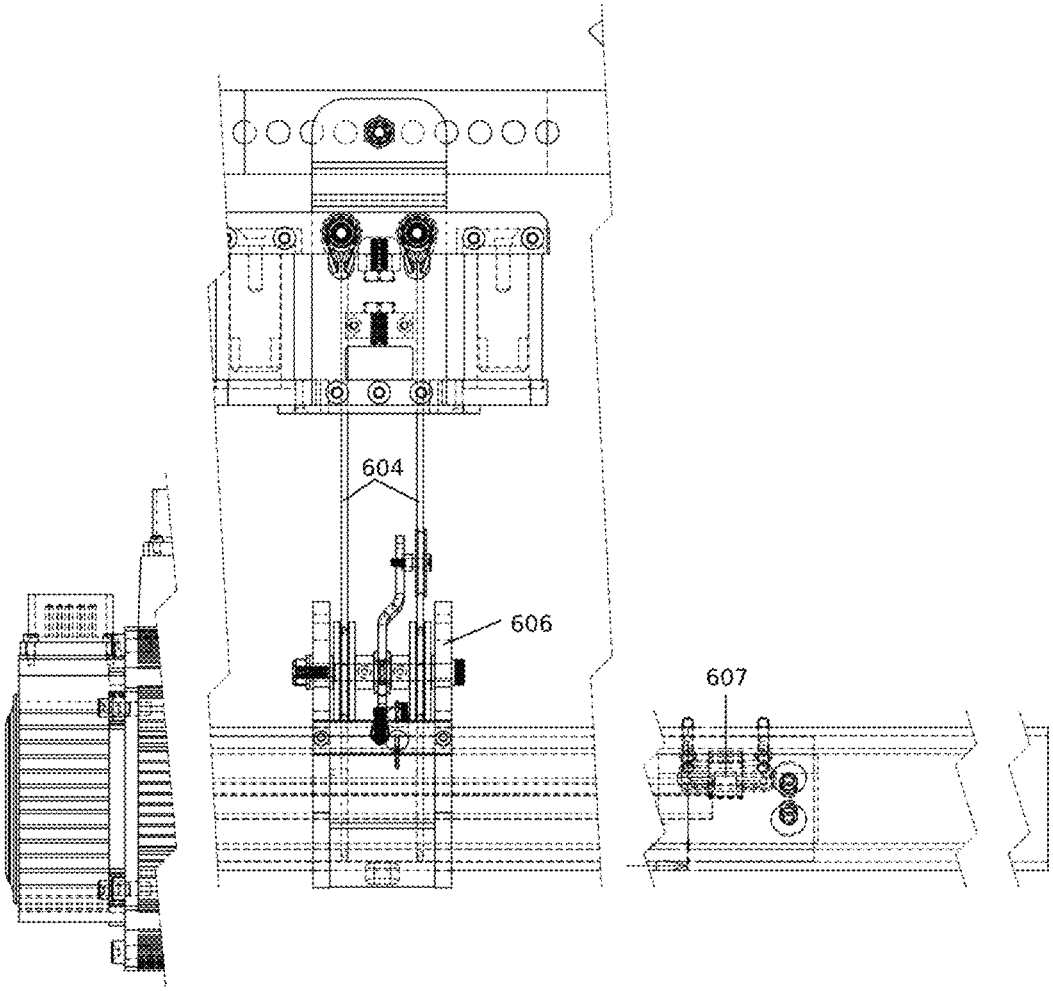
FIGS. 6A and 6B are detailed perspective views of an embodiment of a mechanism for connecting a wire rope to a double sheave assembly in accordance with the invention.
Figure 6B:
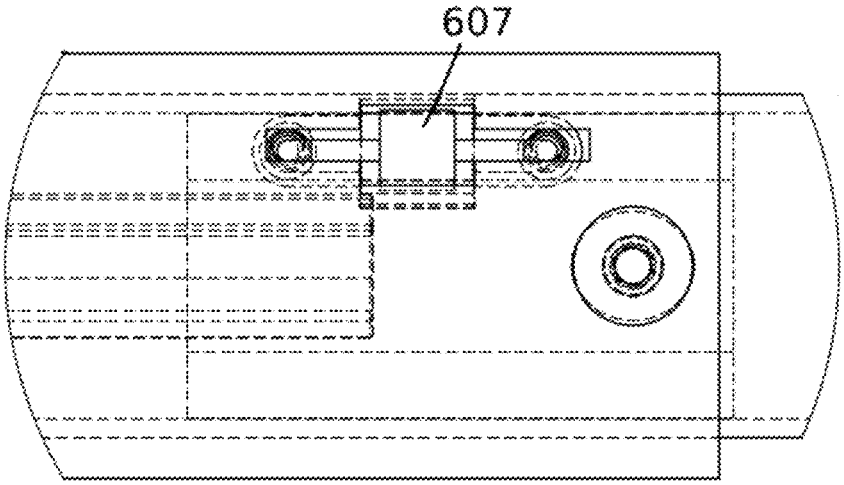

FIGS. 6A and 6B illustrate an embodiment of a mechanism for connecting a wire rope 604 and a sheave assembly 606. As discussed herein, a single length of wire rope 604 may be looped through the sheave assembly 606. In such an embodiment, it may be desirable to include an inline compression fitting 607, such that if the wire rope 604 fails in one of the two parallel portions, the hoist 600 will remain supported by the remaining length of wire rope 604, by virtue of the compression fitting preventing the wire rope 604 from freely pulling out of the assembly 606.

Figure 6C:
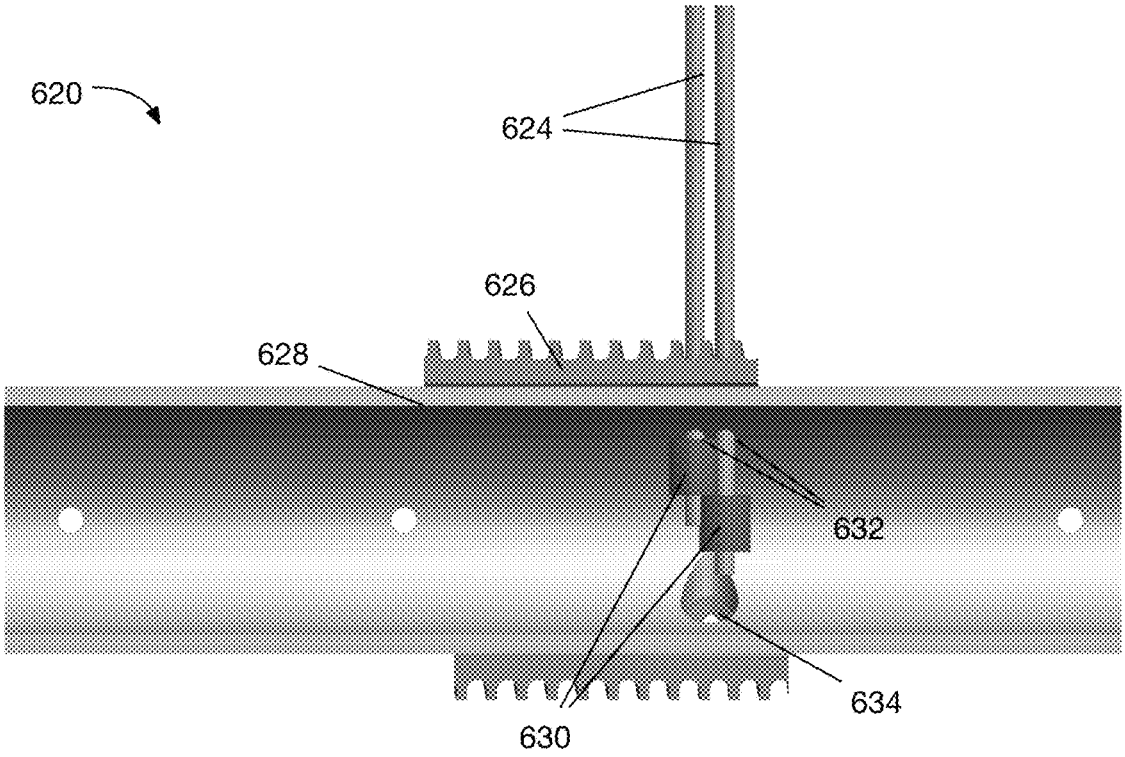
FIGS. 6C-6E illustrate an elongate member termination method and mechanism in accordance with the invention.
Figure 6D:
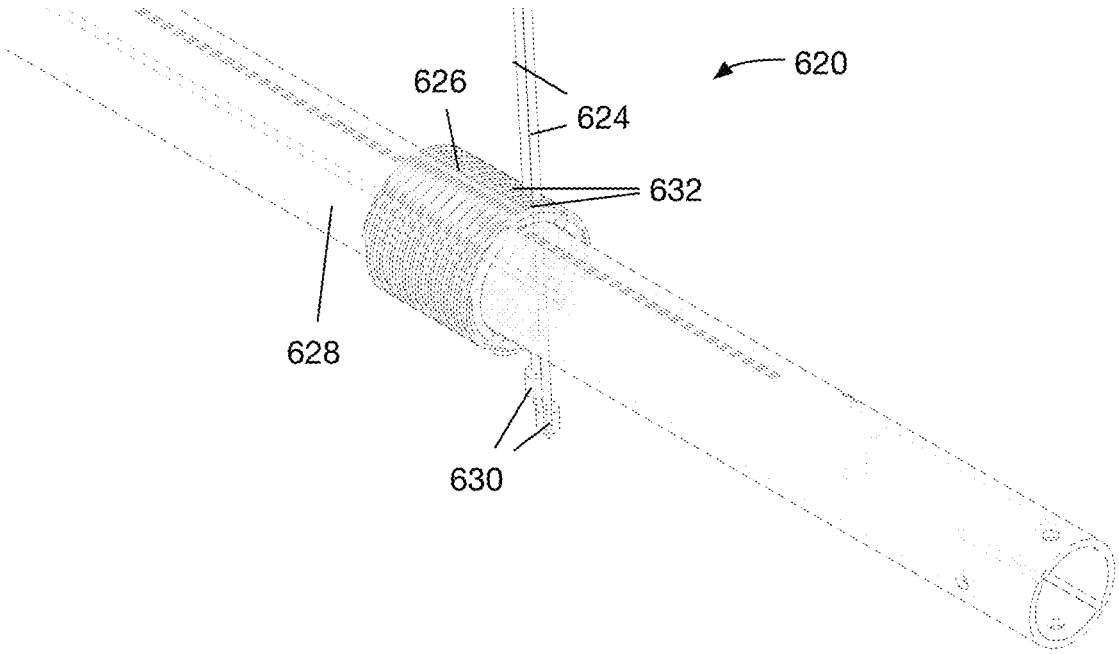
Figure 6E:
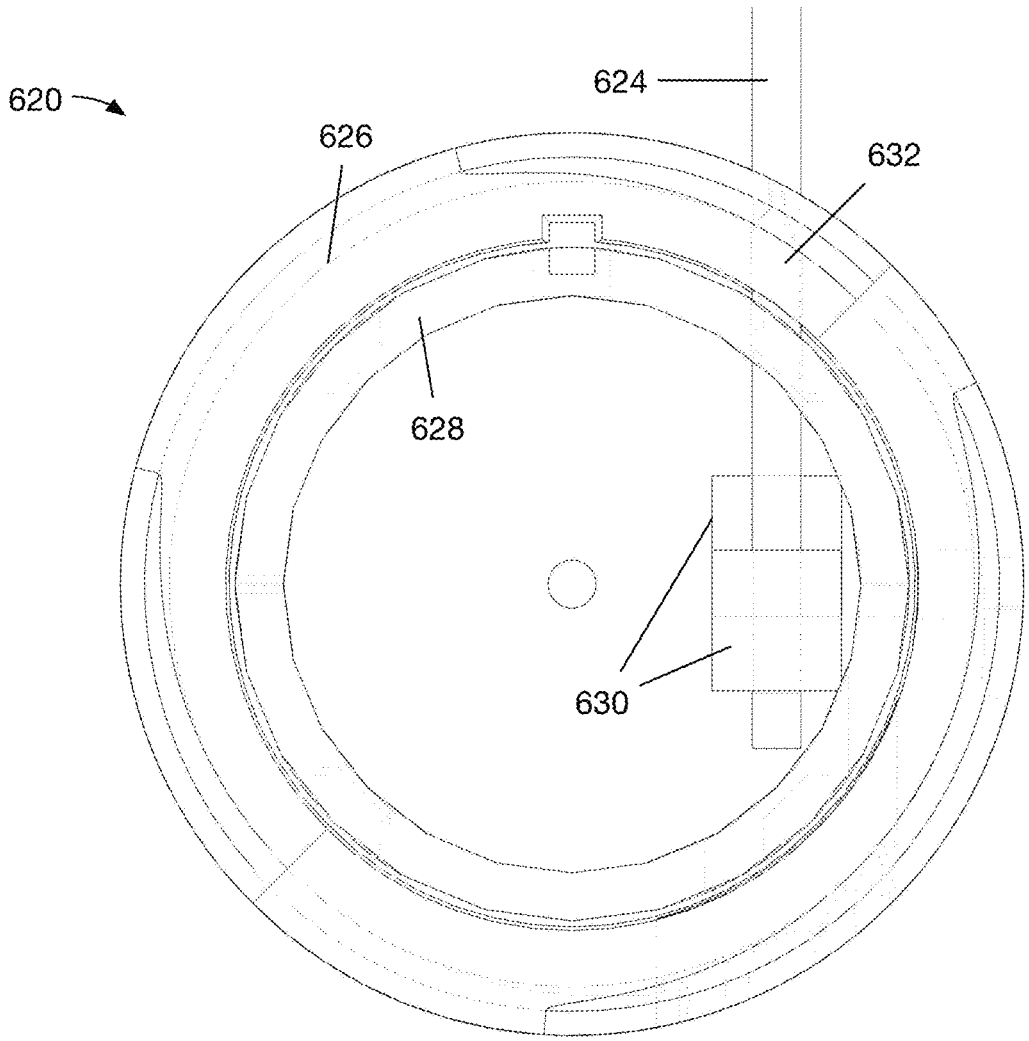

FIGS. 6C-6E illustrate an alternative embodiment of a rope termination strategy, where independent lengths of elongate member are utilized, as opposed to a single looped member. Referring to FIG. 6C, in a hoist 620, elongate members 624 may terminate internally to a drum 626 and its drum shaft 628. The elongate members 624 as illustrated have been fitted with Nico stop sleeves 630 or other appropriate mechanism for preventing the elongate members 624 from passing through holes 632. In one embodiment, as illustrated by Figure C, two elongate members 624 may be positioned for winding about the drum 626 in parallel drum channels, as described herein. As shown in greater detail in FIG. 6D, at installation (or re-installation), the elongate members may be fed temporarily through the entirety of the drum 626 and the drum shaft 628 through a second, larger hole 634, for application of the stop sleeves 630. Thereafter, the clamped ends of the elongate members 624 are fed back through the hole 634 to their operational position within the drum 626 and its drum shaft 628. In one embodiment, the operational holes 632 are ⅛ inch and the larger installation/replacement hole 634 is ½ inch, but much variation is contemplated, depending upon a size of elongate members 624, among other factors. FIG. 6E further illustrates the operational position of the elongate members 624 in cross section. The method and apparatus described provide in many embodiments a fast and efficient means for installing or replacing wire rope and related members, simplified versus many conventional methods.

Figure 7A:
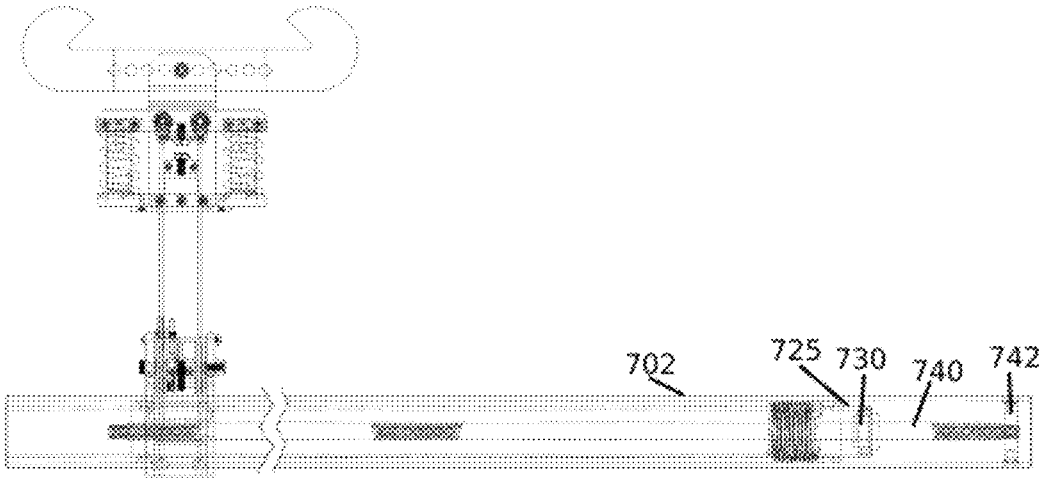
FIG. 7A is a detailed perspective view of the internal components of an embodiment of a hoist system in accordance with the invention.
Figure 7B:
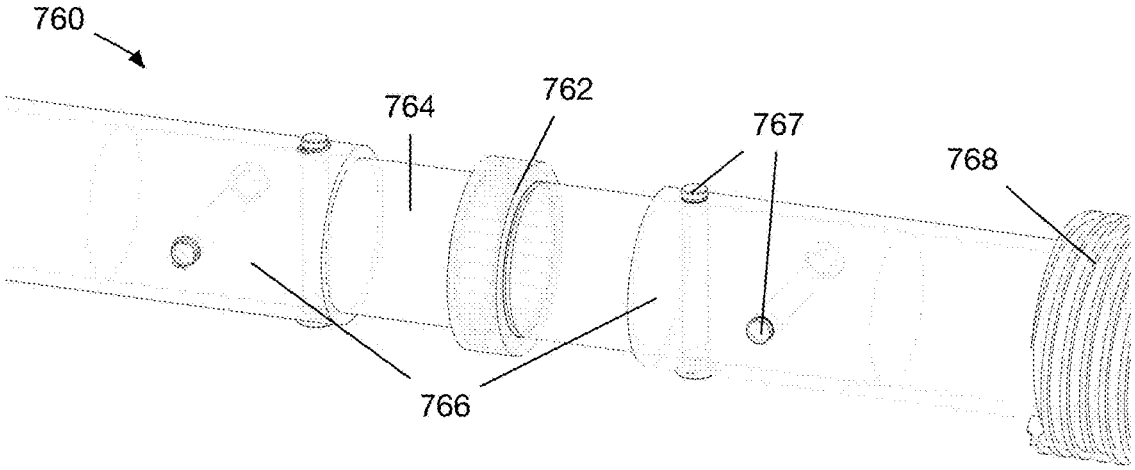
FIGS. 7B and 7C illustrate embodiments of a hoist utilizing a shaft bearing in accordance with the invention.
Figure 7C:
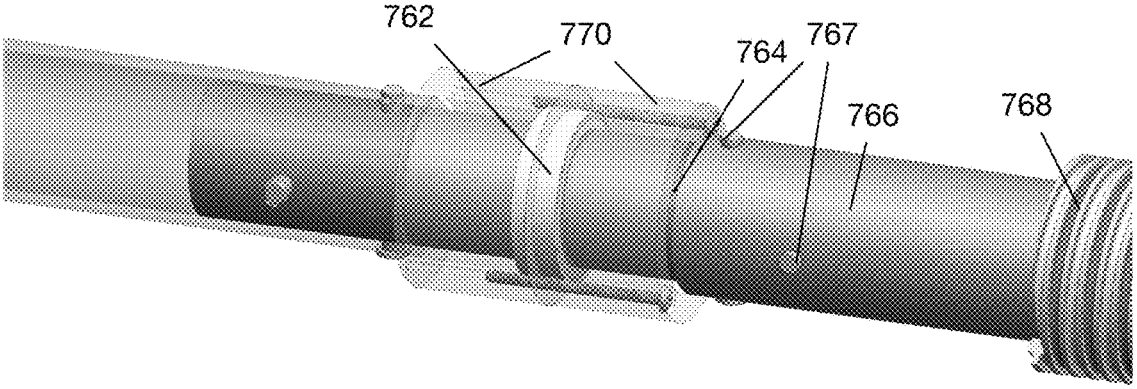
Figure 7D:
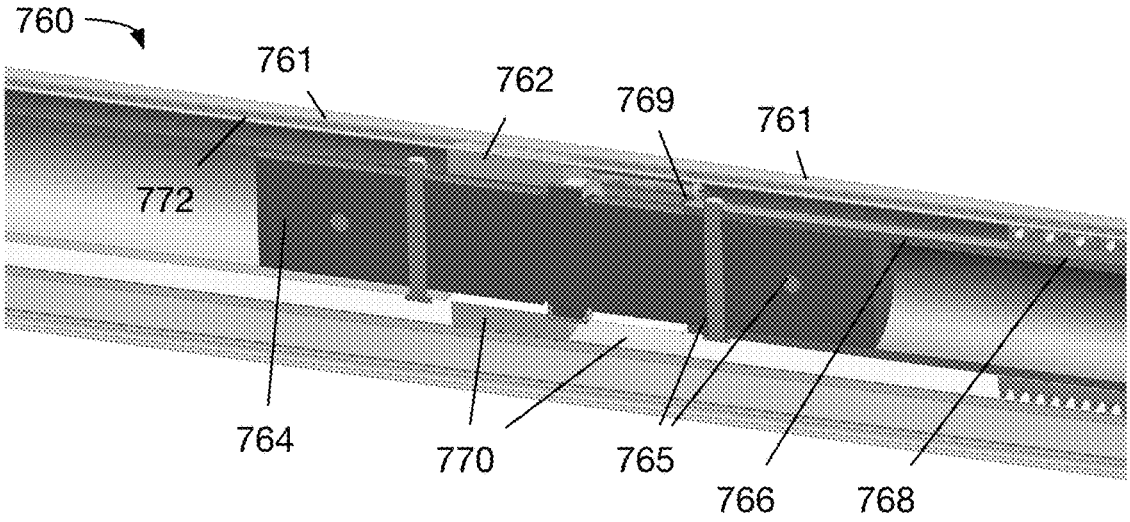
FIG. 7D illustrates a cross section of the embodiment of FIG. 7C.

An enlarged view of the cooperation between a drum shaft 725, an acme nut 730 and an acme screw 740 in accordance with an embodiment of the invention is provided by FIG. 7A. The acme screw 740 in this embodiment is coupled to an interior wall of the pipe batten 702 by an acme screw anchor 742. As disclosed herein, as the acme screw 740 turns with respect to the screw anchor 742 (and pipe batten 702), the acme screw 740 and the drum (not shown) is drawn or pushed in a direction substantially parallel to the length of the pipe batten 702, depending upon a direction of rotation of the acme screw 740. Alternatively, the acme rod 740 may be held fixed, while an acme nut, e.g., screw anchor 740 is attached to the drum and rotates therewith. As the acme nut 740 turns, it travels along the acme rod 740, moving the drum laterally.

As noted herein, a drum and batten may be chosen such that the interior surface of the batten and the exterior surface of the drum are intended to remain in slight contact during operation, or may be separated. In either scenario, but in particular in an embodiment in the latter category, a spacing device may be placed along the length of a drive shaft of the drum, to maintain a proper position thereof with respect to the batten. FIG. 7B illustrates a hoist 760 having a bearing 762 which may be a ball bearing, needle bearing, or other appropriate bearing, or other similarly functioning item. In this embodiment, the balls, needles, etc., are seated within a circular housing such that a portion thereof emerges from an inner surface, contacting a bearing shaft 764, facilitating rotation thereabout. Alternatively, a two-section bearing may be used, whereby an outer ring of the bearing 762 rotates about an inner ring fixed to a bearing shaft 764, with bearings of whatever form sitting between the two sections for free rotation. Other alternatives will be apparent to one skilled in the art. The bearing shaft 764 may be a relatively short (with respect to a length of the batten), solid steel shaft, among numerous other alternatives.

In the embodiment illustrated, the bearing shaft 764 couples two sections of drum shaft 766 to which it is attached by pins 767 or other suitable attachment means. At least one drum 768 is attached to at least one section of the drum shaft 766. The bearing 762 may be held in place on the bearing shaft 764 by retaining rings, etc. (not shown). FIG. 7C further illustrates a bearing housing 770 that may be placed about the bearing 762, this assembly thereafter being inserted into the batten (not shown in FIG. 7C). As illustrated, in one embodiment, the bearing housing 770 may be a two-part, clam shell type assembly, the two parts of which may be fixed to one another to maintain a position with respect to the bearing 762. The housing 770 may be formed from a material having a coefficient of friction low enough such that it may slide laterally during operation along with the one or more drums (e.g., under force of an acme screw or other means, as disclosed herein), as well as during installation. While translating, the bearing 762 may remain fixed rotationally with respect to the batten, while the drum and drum shaft rotate with respect to the batten. In this way, the bearing housing 770 maintains the bearing shaft 764, drum shaft 766, and drum 768 in a central position along their shared axis, while permitting free rotation and translation of the same within the batten. In one embodiment, bearings 762 are placed on each side of a drum 768, to minimize deflection within the batten near the location where a hoist typically experiences the greatest forces in a direction substantially perpendicular to an axis of rotation of the drum.

FIG. 7D reveals still further detail as a cross section of this portion of the hoist 760, along an axis of rotation of the drum 768. As in FIG. 7C, FIG. 7D illustrates the hoist 760, bearing 762, bearing shaft 764, drum shaft 766, drum 768 and bearing housing 770. FIG. 7D further illustrates a batten 761 encasing the hoist 760, pins 765 that may be utilized to couple a bearing shaft 764 with a drum shaft 766, and one of a number of screws 769 that may be used to connect opposing portions of the bearing housing 770. An optional sheath 772 is also provided, that might be positioned on an inner surface of the batten 761. The sheath 772 may be inserted as an add-on and affixed by rivets, for example, or may be included as part of an initial extrusion process, among other possibilities. In certain embodiments, the sheath 772 may be formed from a plastic or other material having a low coefficient of friction with respect to a material of the drum 768, while the batten 761 may be formed from aluminum or other lightweight yet durable material. The sheath 772 may be provided to reduce noise, vibration, and/or friction, that might otherwise result during rotation of the drum 768 due to contact between the drum 768 and the batten 761. The sheath 772 might form a complete cylinder (or other appropriate shape of an internal portion of the batten 761), with gaps to allow exit of elongate members. Alternatively, the sheath 772 might take the form of a strip or strap, positioned at a portion of the batten interior where contact and undesired friction is most likely to occur, or might take the form of a cylinder having a cutout strip (e.g., a c-shaped cross section) to allow elongate members to exit.

Figure 7E:
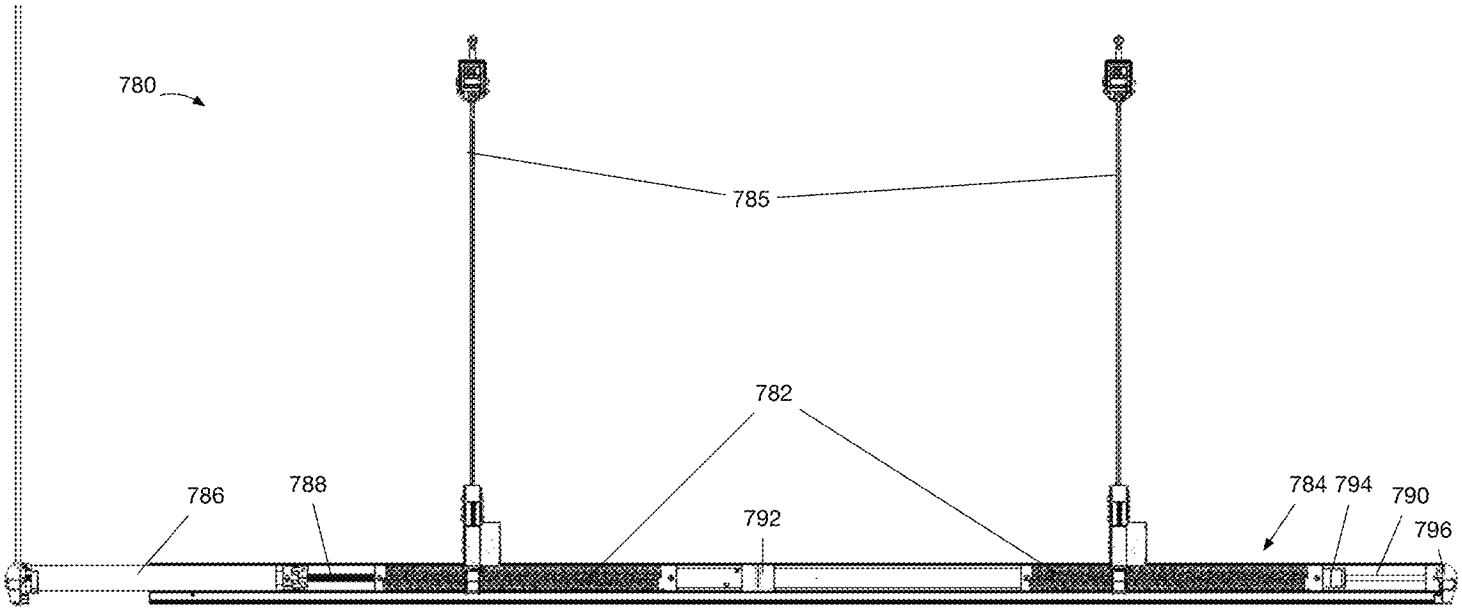
FIG. 7E illustrates an embodiment of a compact hoist in accordance with the invention.

One invention as described herein is a self-climbing pipe. FIG. 7E illustrates an exemplary embodiment as a hoist 780. As shown, one or more drums 782 is mounted inside a pipe/batten 784 and attached to a motor 786. The motor may be a tubular motor inside the pipe as illustrated, or attached externally. As the motor operates, rotational force is applied to the drum to which wire ropes or other elongate members 785 are attached, causing the pipe to climb the ropes. As the drum rotates it also translates (under force imparted by a stationary screw 790 against a nut 794, in one embodiment) at a rate coordinated with a groove-spacing of the drum, thereby maintaining a constant zero fleet angle between 1) the point in the drum groove at which wire rope is filling or leaving the drum and 2) an exit hole in the pipe. The rotational force of the motor may be transferred to the drum by a spline shaft 788. A bearing/housing 792 may be provided as disclosed herein. End caps 796 may be provided for protection and/or as a safety mechanism as desired. Multiple drums may be coupled in succession, with the series being coupled to a screw or other means to effect the translational force described. The motor may remain laterally stationary, or may be coupled to a linear bearing or other means preventing rotation of the motor but allowing it to translate with the moving drums.

Figure 8A:
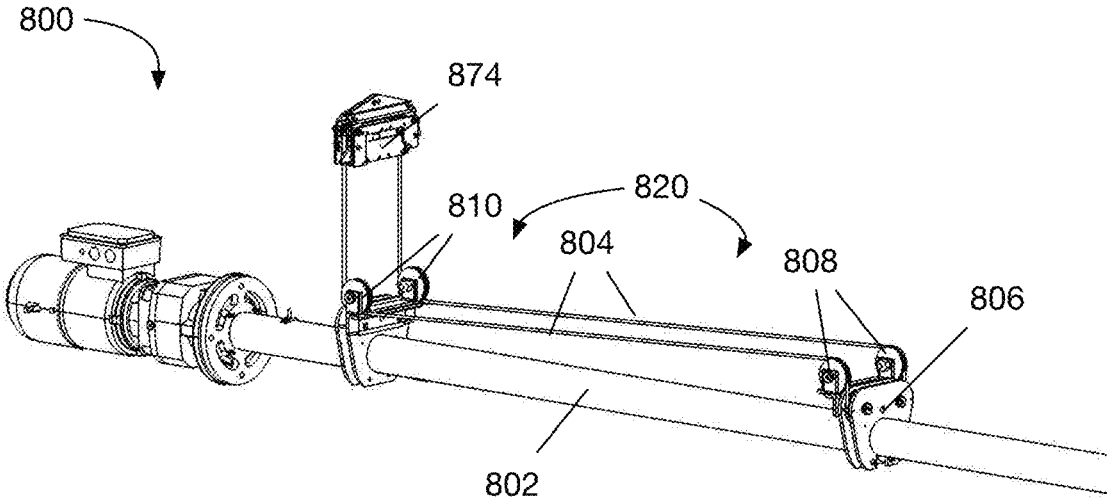
FIGS. 8A and 8B illustrate perspective views of alternative embodiments of a diverter pulley system in accordance with the invention.

Herein, various hoist systems have been illustrated by way of example as primarily having elongate members exiting a batten or related structure and extending substantially vertically, such as to fixed overhead locations. It should be noted, however, that a hoist system in accordance with the invention is further versatile in this aspect. FIG. 8A illustrates a hoist system 800 with a batten 802 having connected thereto a double sheave elongate member exit assembly 806 that has been adapted for use with a diverter pulley system 820, which may be termed a muled diverter. An exemplary exit assembly is shown in greater detail in FIG. 8B as an exit assembly 850. The pulley system 820 is mounted with respect to a sheave assembly 806 to divert elongate members 804 approximately laterally along the batten 802 through the use of sheaves or pulleys 808, 810, in order adapt to varying overhead attachment locations and scenarios. An exemplary such overhead attachment assembly is illustrated as a mount 847.

Figure 8B:
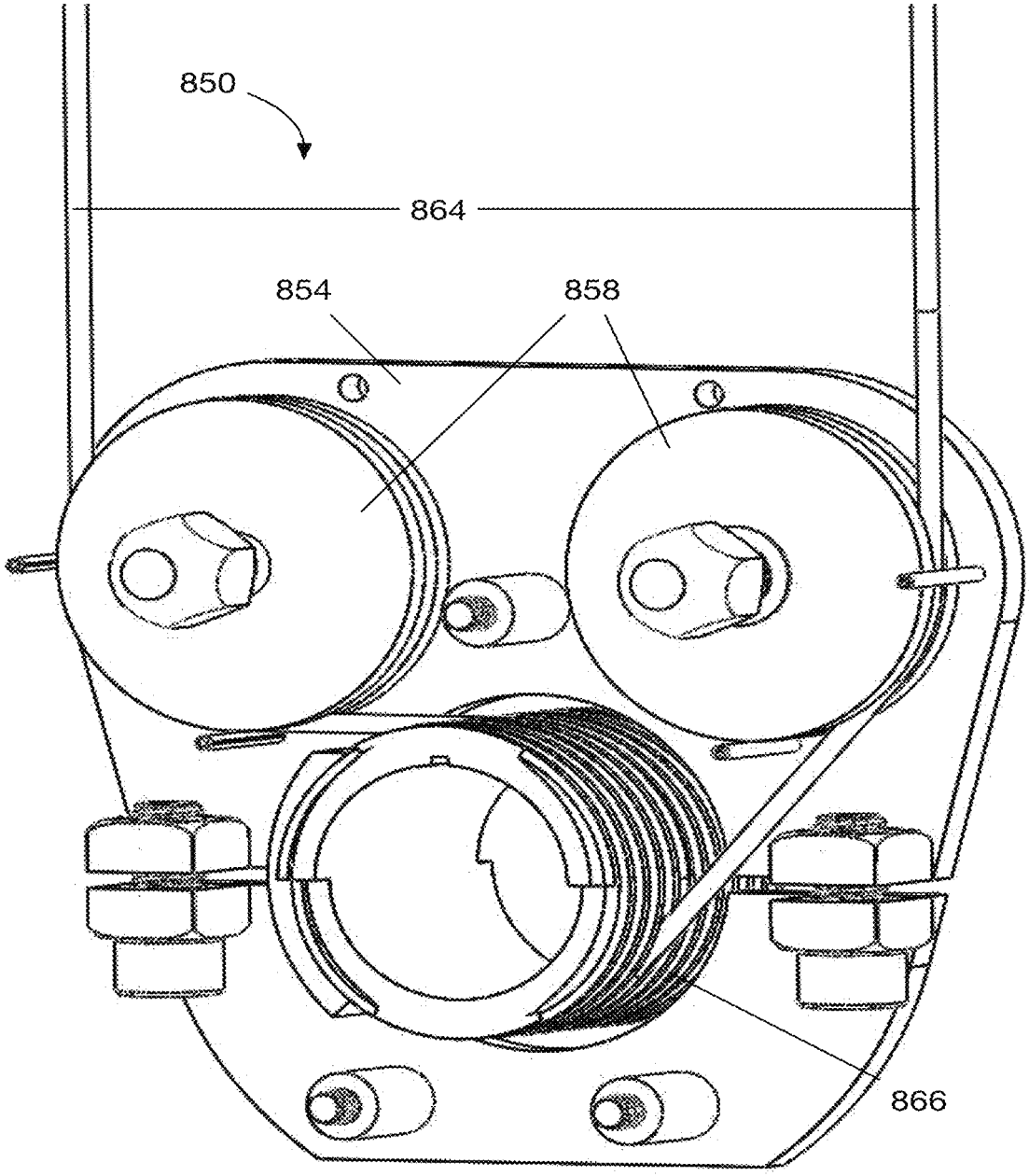

In the embodiment of FIG. 8B, elongate members, rather that exiting substantially vertically upward to an overhead support structure, exit the enclosure instead at, for example, approximately 3:00 and 11:00 (where, as will be readily appreciated by one skilled in the art, 12:00 represents a direction/angle vertically upward toward an overhead support, when viewing a cross section of the enclosure, e.g., a batten). The exit mechanism 850 includes a multi-part plate apparatus 854 supporting a double-pulley arrangement 858, wherein the individual pulleys are separated by a distance, and in operation may rotate in opposite directions while guiding a direction of the elongate members 864 as they exit from a drum 866 through the enclosure.

Figure 8C:
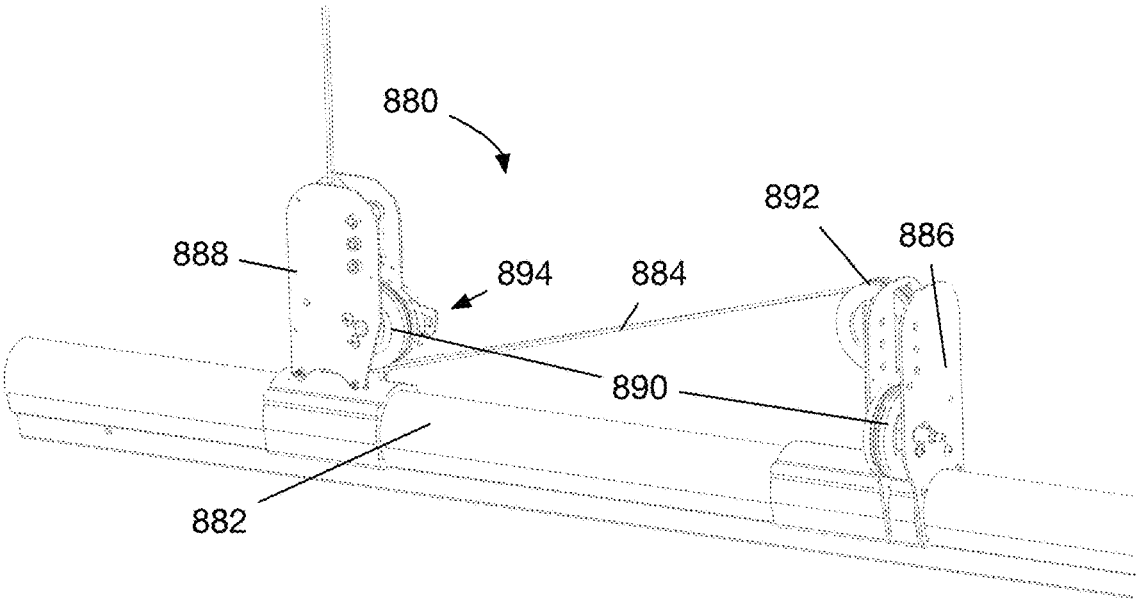
FIG. 8C illustrates an alternative embodiment of a diverter pulley system in accordance with the invention.

FIG. 8C illustrates an alternative embodiment as a diverter system 880 for a hoist 882, for diverting a pair of elongate members 884 along a length of the hoist 882. The diverter system 880 includes a double sheave or pulley diverter assembly 886 at an exit location of the elongate members 884 from the hoist 882. In this embodiment, the diverter assembly 886 includes a standard sheave 890, and a stepped sheave 892 (shown in greater detail in FIG. 8D). The sheave 892 is stepped, as described in greater detail herein, to accommodate a greater distance traveled by one of the elongate members 884 from an exit point of the hoist 882 to an attachment point of the elongate members 884, due to a change in direction from approximately vertical to along a length of the hoist 882. A second sheave assembly 888, which may be a standard exit assembly, is provided to further redirect the diverted elongate members 884 about a sheave 890 to a substantially vertical direction, toward an overhead attachment point. The sheave 890 of assembly 888 may further form a part of an overspeed braking mechanism 894, discussed in greater detail herein.

Figure 8D:
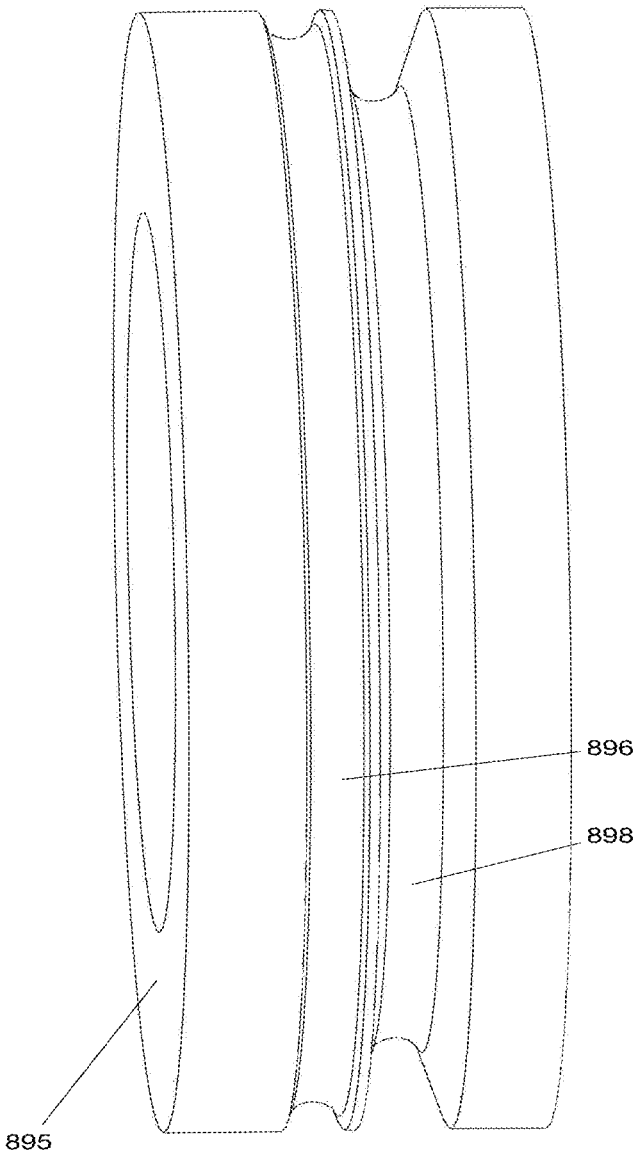
FIG. 8D illustrates in greater detail an offset sheave in accordance with the invention.

FIG. 8D illustrates an exemplary stepped pitch sheave 895. The stepped pitch sheave 895 includes a groove 896 having a greater pitch or diameter that an adjacent groove 898. The groove 896 is adapted to receive and increase the distance traveled by an elongate member 884 that would otherwise cover a shorter distance as a direction of the elongate members 884 changes through the diverter system 880 (see FIG. 8C), acting to equalize forces experienced by the elongate members 884 at termination at the hoist 882.

Figure 9:
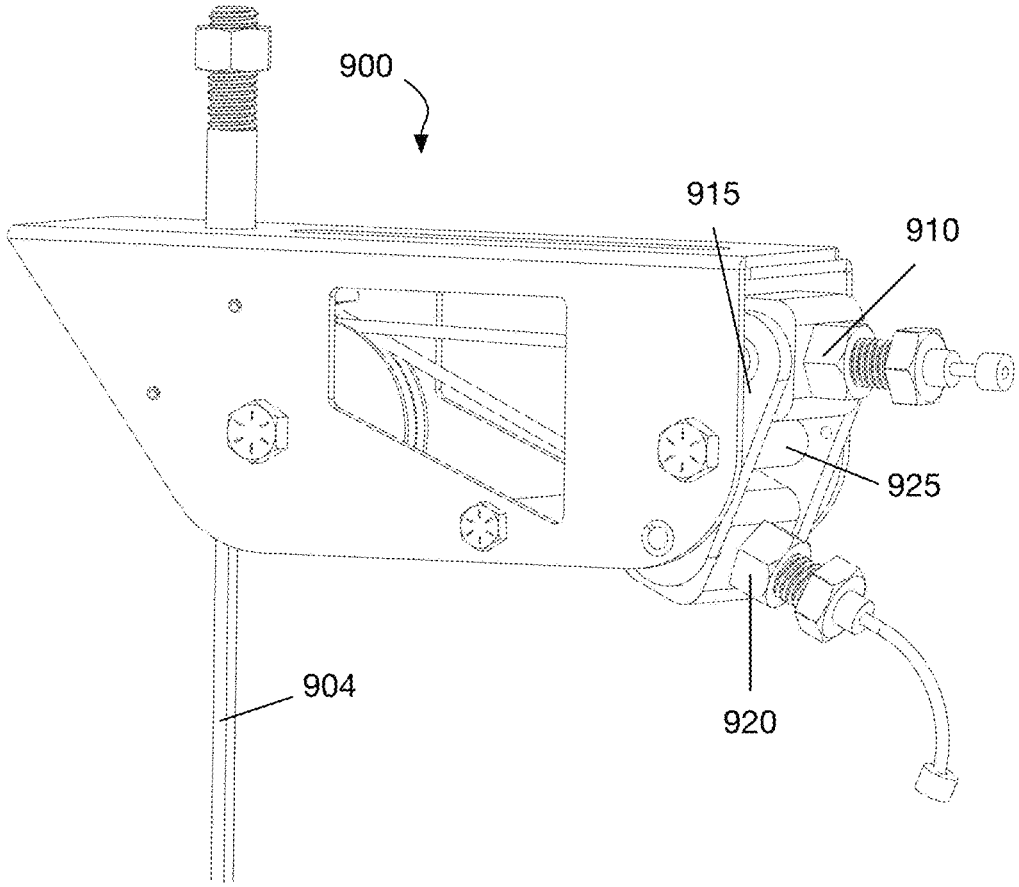
FIG. 9 illustrates an embodiment of a load-balancing trim mechanism in accordance with the invention.

FIG. 9 illustrates an optional mechanism that may further aid in equalizing forces experienced by paired elongate members 904. The load balancing trim mechanism 900 includes two elongate member termination points 910 and 920 coupled by a rocker arm 915. The rocker arm 915 is connected to a pivot point 925, such that it may rotate freely thereabout, and may rock or seesaw, depending upon forces respectively applied to the termination points 910 and 920 by the elongate members 904. Permitting the rocker arm 915 to move about the pivot point 925 approximately balances the respective loads experienced by the paired elongate members 904, significantly equalizing them. An additional benefit in certain embodiments results from dual independent elongate members 904 being used (as opposed to a single elongate member looped about a sheave, for example), is that if an elongate member fails, in the embodiment of FIG. 9, an independent elongate member remains as a backup.

As noted herein, an overspeed braking mechanism may be provided for use with a hoist mechanism in accordance with the invention (see, for example, FIG. 8D and accompanying description). In one embodiment of the invention, a brake assembly is placed in a position that is operationally between the hoist and a load, at some point along a path of elongate members used to move the load, such that protection is provided against any of the aforementioned and other failures at the hoist portion of the system that manifest themselves in an overspeed condition along the elongate members.

Figure 10A:
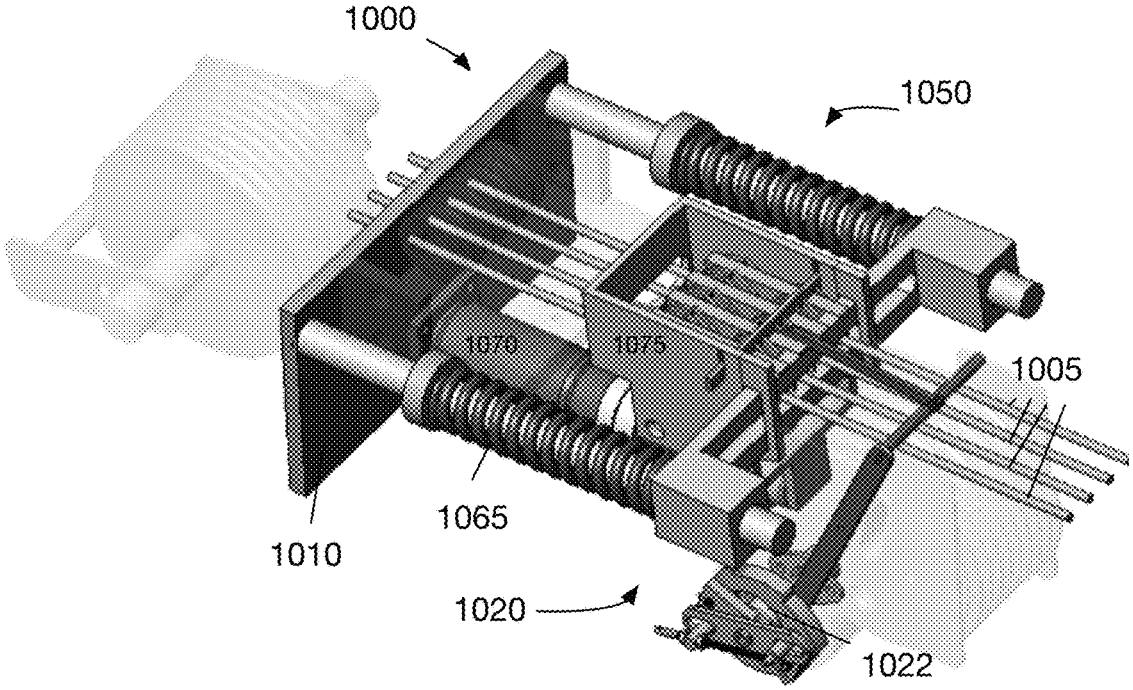
FIG. 10A is a perspective view of an embodiment of an overspeed braking system in accordance with the invention.

An exemplary embodiment is illustrated by FIG. 10A as an overspeed braking mechanism 1000. In this embodiment, the brake assembly is placed along the elongate members 1005 (e.g., wire ropes) which extend in either direction respectively toward a hoist and a load (neither being shown). The assembly 1000 may be installed in a variety of locations, depending upon a particular implementation, including at an enclosure (if provided) of a hoist, such as at an exit point of the elongate members from the hoist enclosure, either internally or externally to the enclosure. Alternatively, the assembly 1000 may be placed separately from the hoist, for example fixed to any support structure to which the hoist may be attached, or any other point along the elongate members 1005. In either scenario, the brake assembly 1000 may optionally be provided with its own enclosure, as is partially illustrated by FIG. 10A as a carriage assembly 1010. While FIG. 10A illustrates an embodiment adapted for use with a set of four elongate members 1005, one skilled in the art will appreciate that the concepts herein may likewise be applied to many different systems.

Within the carriage assembly 1010 are illustrated an overspeed detection portion or mechanism 1020 and a braking portion or mechanism 1050. The overspeed detection mechanism 1020 may be any of a variety of means for determining a rate of travel of the elongate member 1005, and whether it exceeds a predetermined maximum. Possibilities range from higher technology electronic detection mechanisms to generally simpler, less expensive approaches. Detection of an overspeed condition may likewise be communicated to other portions of the system in a variety of ways, electrically/electronically, mechanically, etc.

In the illustrated embodiment, the overspeed detection mechanism 1020 is illustrated as a mechanical arrangement. The overspeed detection mechanism 1020 may include a linkage such as a roller (not shown) having a shaft 1022 that rotates in unison with the lateral movement of the elongate members 1005. This may be by way of direct contact between the roller and one or more elongate members 1005, or indirectly through an arrangement of shafts, pulleys, gears, etc., in contact with the elongate members 1005, as applicable in a particular environment.

Figure 10B:
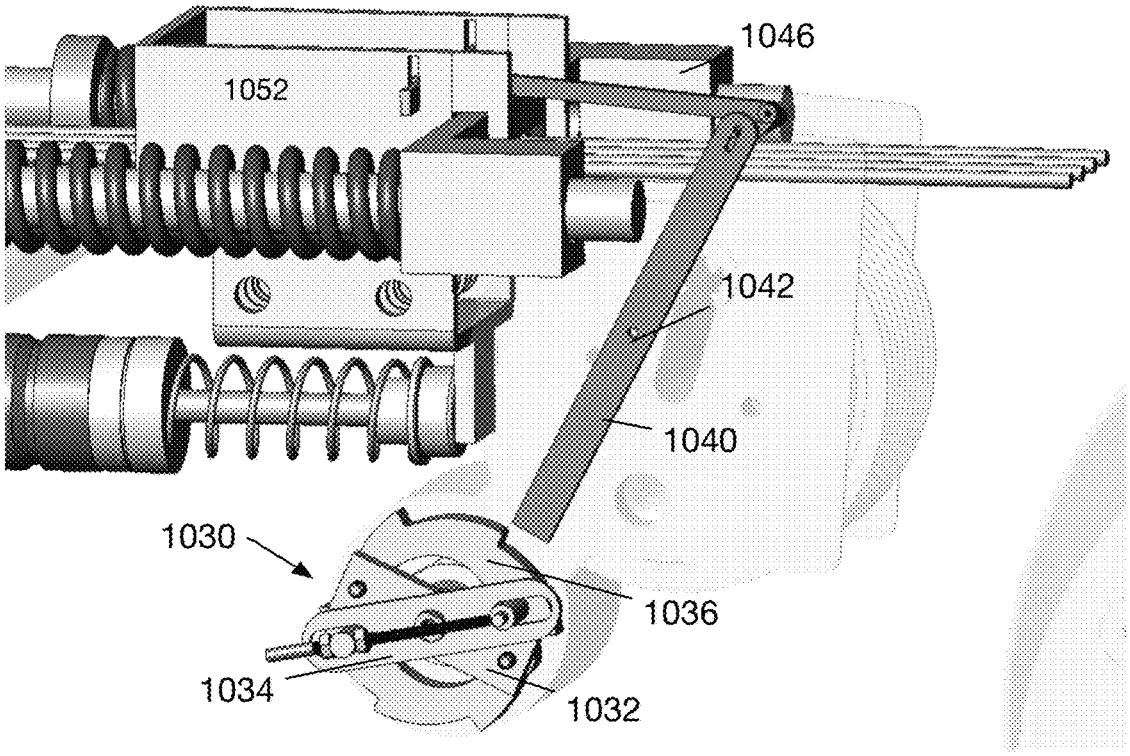
FIG. 10B is a partial perspective view of an embodiment of a centrifugal mechanism of an overspeed braking system in accordance with the invention.

Connected to the shaft 1022 is a means for detecting rotational speed. In an exemplary embodiment, this mechanism may comprise a centrifugal mechanism 1030, shown in greater detail in FIG. 10B, including an inner link 1032 and an outer link 1034 that turn in relation to the shaft 1022 and support one or more dogs 1036. The inner and outer links 1032 and 1034, in conjunction with the dogs 1036, collectively move from a resting position as shown in FIG. 10B to an extended position (illustrated in greater detail in FIG. 11B), upon sufficient rotation of the shaft 1022 (corresponding to movement of the elongate members 1005). A more detailed illustration of the resting and extended positions of the centrifugal mechanism 1030, and the cooperation of the inner and outer links 1032 and 1034 and the dogs 1036, are provided herein with respect to FIG. 11.

The mechanism 1030 may be biased toward the resting position, as by a spring or tension arm (not shown). Design parameters of the centrifugal mechanism 1030, e.g., radial distance from a center of the shaft 1022 to the dogs 1036, mass of the dogs 1036, ratio of rotational speed of the shaft 1022 to a lateral movement of the elongate members 1005, tension in the pivot points or other connections, etc., may be varied to determine a rate of travel of the elongate members 1005 that will result in an expansion of the centrifugal mechanism 1030.

Figure 10C:
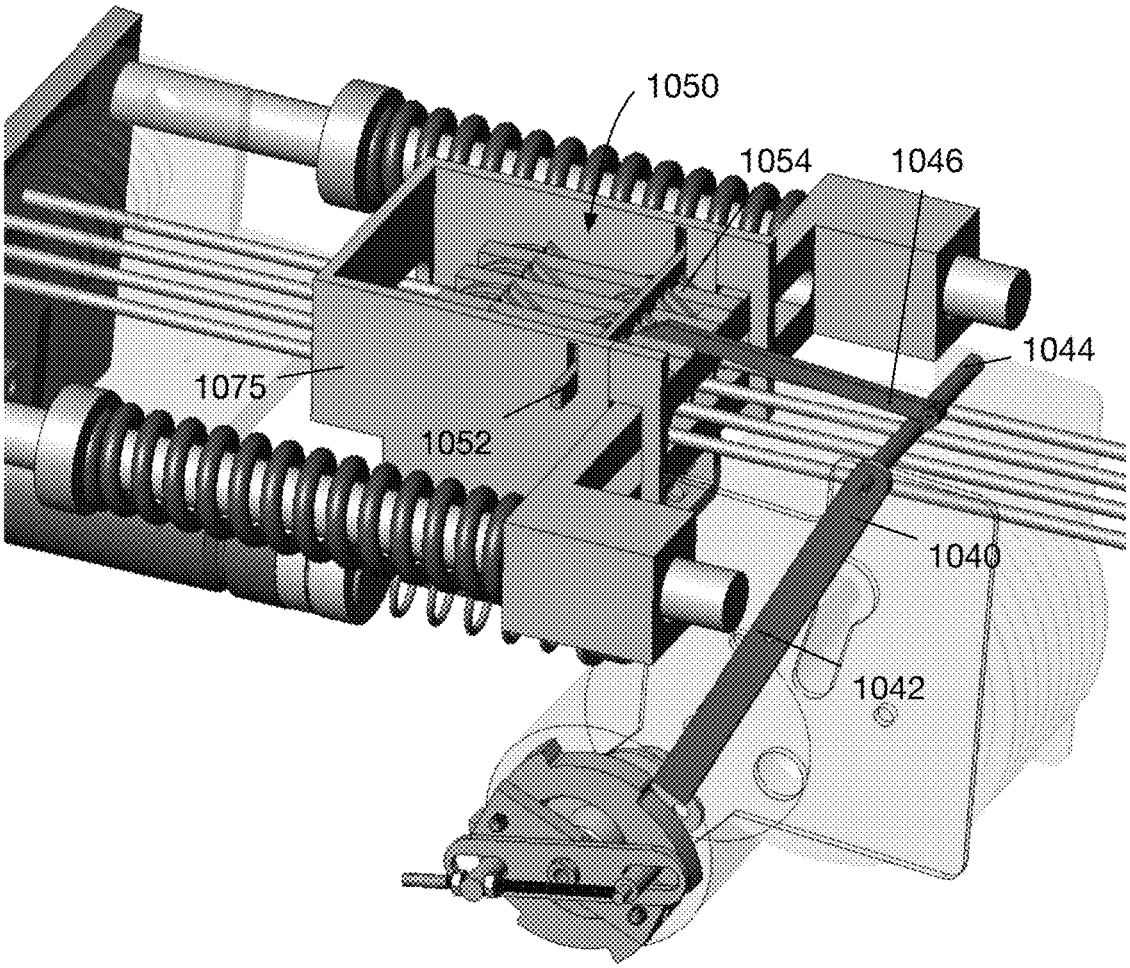
FIG. 10C is a partial perspective view of an embodiment of a brake linkage mechanism of an overspeed braking system in accordance with the invention.

Upon sufficient expansion, one or more dogs 1036 will contact a brake linkage 1040, causing the brake linkage 1040 to pivot counterclockwise (in the perspective of the view illustrated by FIG. 10A) around a pivot 1042, actuating a crossbar 1044. This exemplary arrangement is shown in greater detail in FIG. 10C. In the illustrated embodiment, the crossbar 1044 has connected thereto a wedge linkage 1046 that, upon actuation of the crossbar 1044, moves a latch 1052 away from a set of teeth 1054. As discussed in greater detail below, the teeth 1054 are part of a system of one or more braking jaws 1062 (pairs of jaws 1062 are illustrated; see FIG. 10D and associated description) that upon actuation clamp down upon the one or more elongate members 1005, halting their movement between the jaws 1062.

In order to lessen an impact on the system that might result from halting a movement of the elongate members 1005, one or more damping mechanisms might be provided. Referring again to FIG. 10A, exemplary damping mechanisms are illustrated as a pair of springs 1065 and a piston damper 1070. The pair of springs 1065, piston damper 1070 and/or other appropriate chosen damping means may be connected as shown between an wall of a carriage assembly 1010, if provided, and an internal cage 1075 or other enclosure of the braking portion 1050, such that a force transferred to the system from the elongate members 1005 upon braking contact with the jaws 1062 is absorbed in part by the damping components, rather than the system experiencing a sudden halting effect. This damping is also experienced by the elongate members 1005, and therefore by any load attached thereto, lessening the probability of damage to the hoist system, braking system, and any supported load. In one specific application, the dampers may be calibrated to reduce a braking impact on the system to a peak of approximately 1.2-1.3 G (g-force).

Figure 10D:
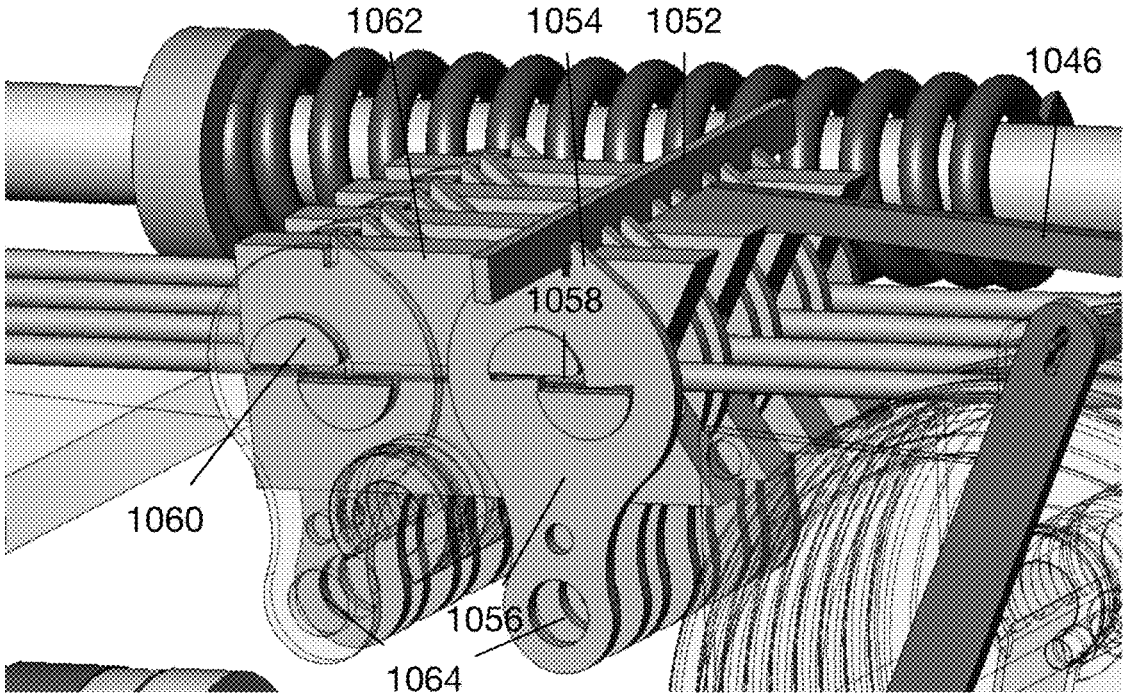
FIG. 10D is a partial perspective view of an embodiment of a braking mechanism of an overspeed braking system in accordance with the invention.

FIG. 10D illustrates an embodiment of a braking portion 1050 in greater detail. As shown in FIG. 10D, which for illustration purposes omits one of the springs 1065 and the cage 1075, the teeth 1054 are formed respectively in a set of keys 1056 that also have formed therein half-moon, or other appropriate shape, cutouts 1058, adapted to receive correspondingly shaped tabs or cogs 1060 of opposing pairs of jaws 1062. The pairs of jaws 1062 may have formed in their adjacent faces a groove that allows an elongate member 1005 to pass through freely when the keys 1056 and jaws 1062 are in a cocked (de-actuated) position. The keys 1056 may be spring-loaded or otherwise biased toward an opposing, actuated position such that, upon release by the latch 1048 of the teeth 1054, the keys 1056 rotate around a pivot point 1064, biasing the individual jaws 1062 of the opposing pairs toward one another under a force applied by an interior walls of the cutouts 1058 against the cogs 1060 of the jaws 1062, as is be explained in greater detail with respect to FIG. 11. This causes the jaws 1062 to clamp down upon an elongate member 1005 passing between the jaws 1062, halting the movement of the elongate members 1005 through the brake assembly 1000.

Figure 11A:
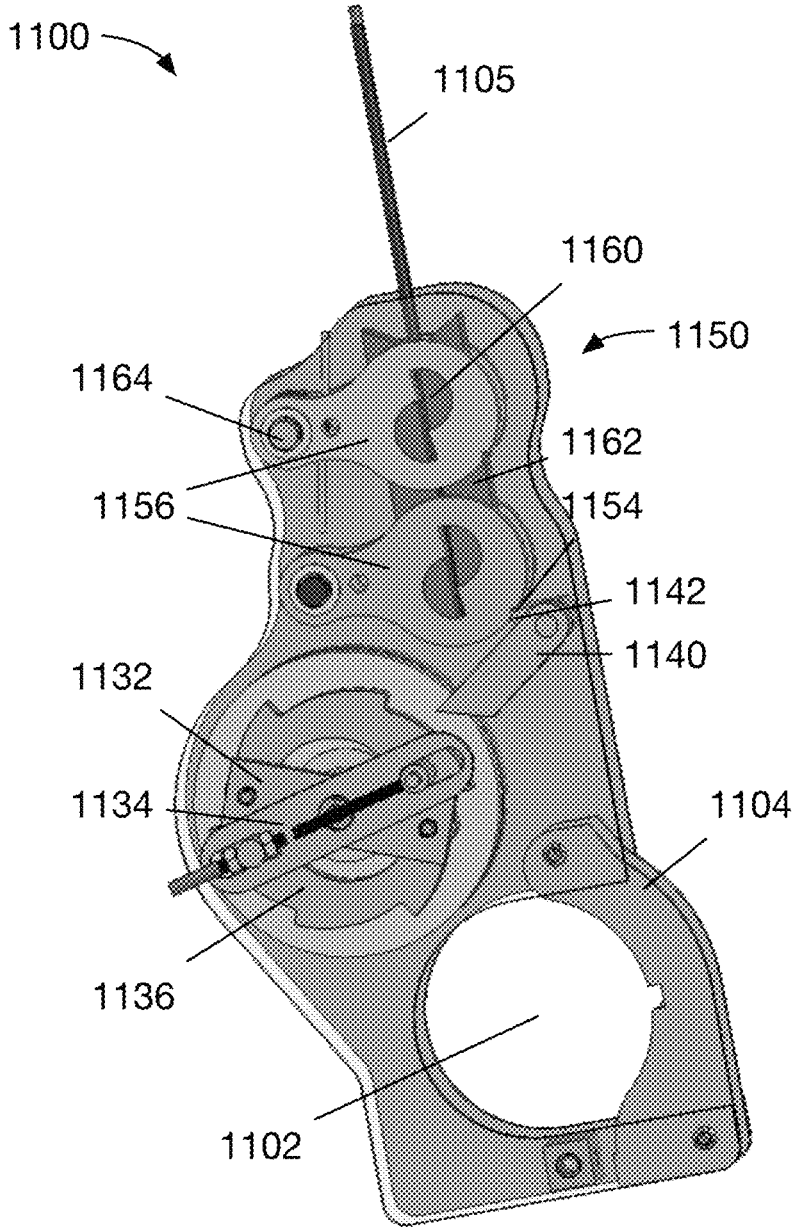
FIG. 11A is an alternative embodiment of an overspeed braking system in accordance with the invention.

FIG. 11A illustrates one of many alternative implementations of the concepts of the invention disclosed herein. In FIG. 11A, an embodiment of an overspeed brake is shown as a braking mechanism 1100. An embodiment as that shown in FIG. 11A might be useful in an environment in which a wire rope or other elongate member 1105 emerges from a lengthwise, relatively narrow structure, such as a tube or pipe, that may be received by an opening 1102 formed by a clamp or bracket 1104. Like other embodiments described herein, the overspeed brake 1100 may include a speed detection mechanism such as a centrifugal mechanism 1130 having an inner link 1132 and an outer link 1134, and centrifugal members 1136.

The centrifugal mechanism 1130 operates, analogously to the brake assembly 1000 shown in FIG. 10, in proximity to a linkage or lever 1140 that, upon actuation by the centrifugal mechanism 1130, actuates a brake assembly 1150. The lever 1140 as illustrated has formed therein a latch 1142 that cooperates with a notch 1154 formed in the first of a pair of linked together keys 1156, which is biased in a direction toward the extending length of elongate member 1105 in the illustrated embodiment. This bias may be provided by, for example, a spring (not shown) wound about a shaft 1164. As disclosed with respect to FIG. 10, the keys 1156 support a pair of jaws 1162 having tabs or cogs 1160. Upon actuation of the latch 1142 by the centrifugal mechanism 1130, the keys 1156 are released, allowing them to pivot in the direction of the elongate member 1105, thereby applying a force on the cogs 1160 that moves the paired brakes 1162 toward one other, clamping down on the elongate member 1105 passing between them.

Figure 11B:
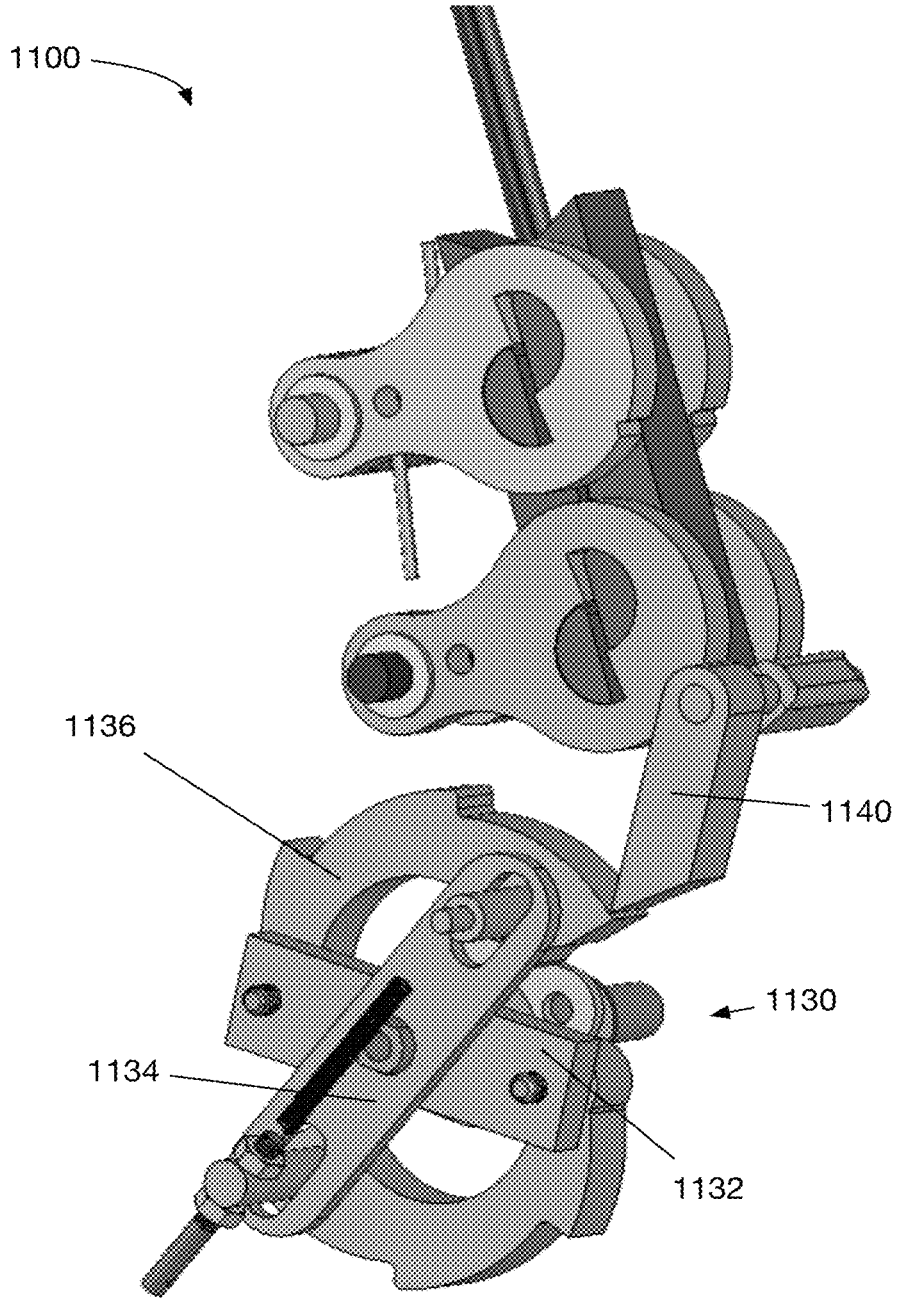
FIG. 11B is a detailed perspective view of a centrifugal speed detection mechanism of an embodiment of an overspeed braking system in accordance with the invention.

FIG. 11B illustrates the centrifugal mechanism 1130 in the actuated position, and further illustrates the mechanical relationship, in this particular embodiment, between the inner link 1132 and outer link 1134, and the centrifugal members 1136. As illustrated, each of the inner link 1132 and the outer link 1134 has one end connected to one end of each centrifugal member 1136 and other end connected to the other end of the centrifugal member 1136. Because the inner link 1132 and the outer link 1134 are connected by a moveable pivot, the centrifugal force generated upon rotation of the assembly allows the centrifugal member 1136 to pivot outward, occupying an increasing circumference as the assembly continues to rotate. When the occupied circumference is sufficiently great, one of the centrifugal members 1136 will contact and trip the latch 1140, actuating the braking mechanism 1100 as further described herein.

As disclosed herein, conventional brakes have been applied at various points in applicable systems. For example, hoist brakes may be applied to a motor or drive shaft, gear box, drum, etc. However, any system failure within the motor, gear box or drum, respectively, might not prevent a lifted load from falling. An overspeed brake disclosed herein might optionally be applied along an elongate member, such that any failure on an opposite side of the load from the brake, e.g., in the motor, gear box, drum, etc., would be protected against. Depending upon a particular application, the invention may be implemented such that only a failure of all elongate members on a load side of the brake would permit a load to fall.

Figure 12A:
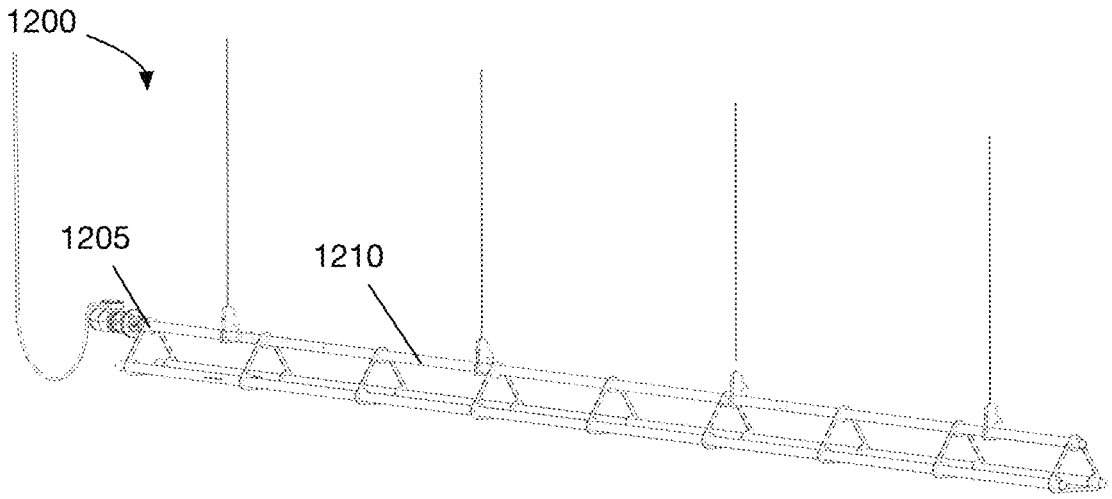
FIGS. 12A-12C illustrate combination embodiments for a hoist in accordance with the invention.
Figure 12B:
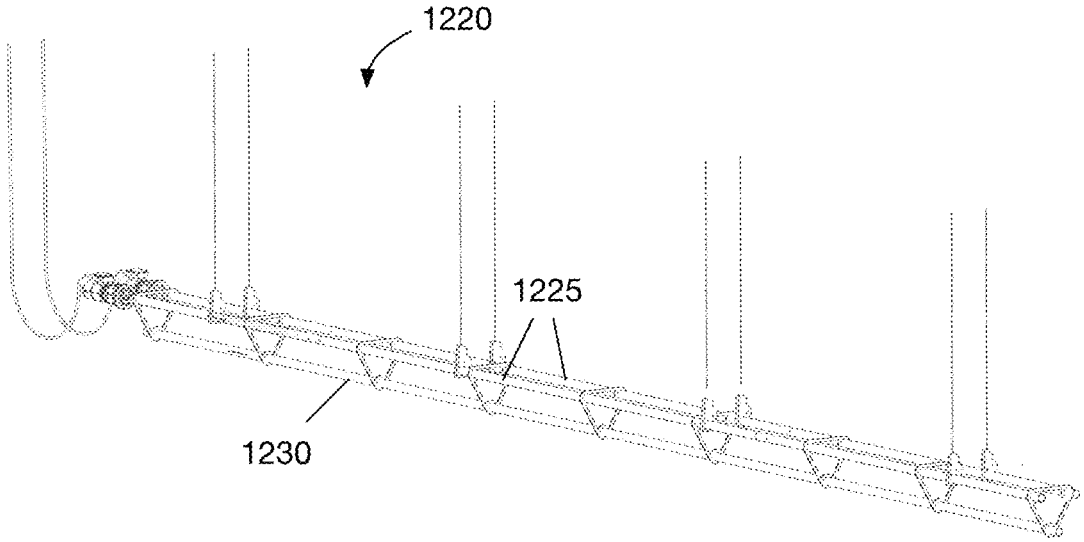
Figure 12C:
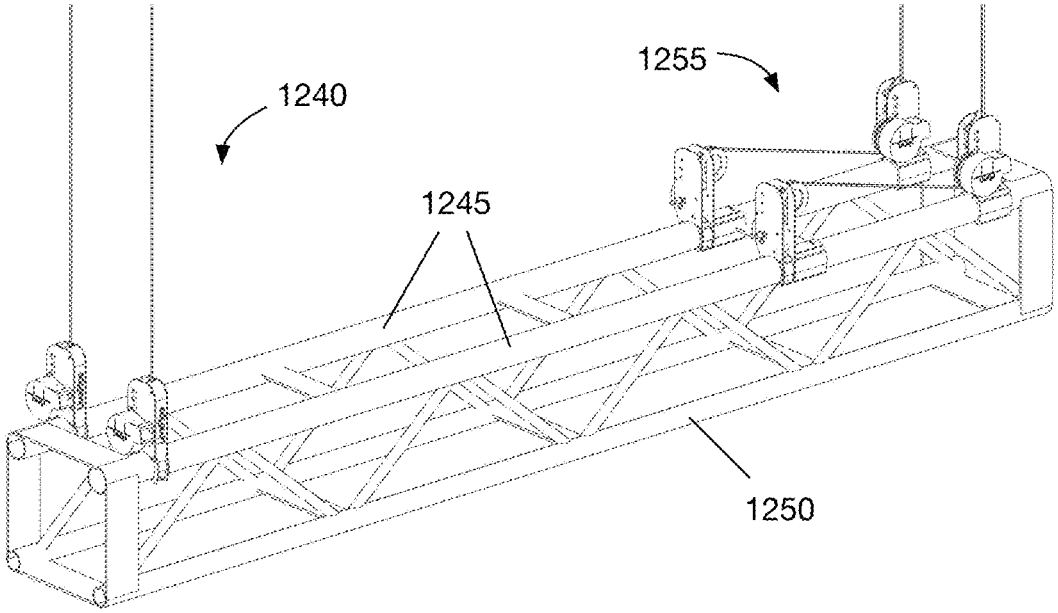
Figure 12D:
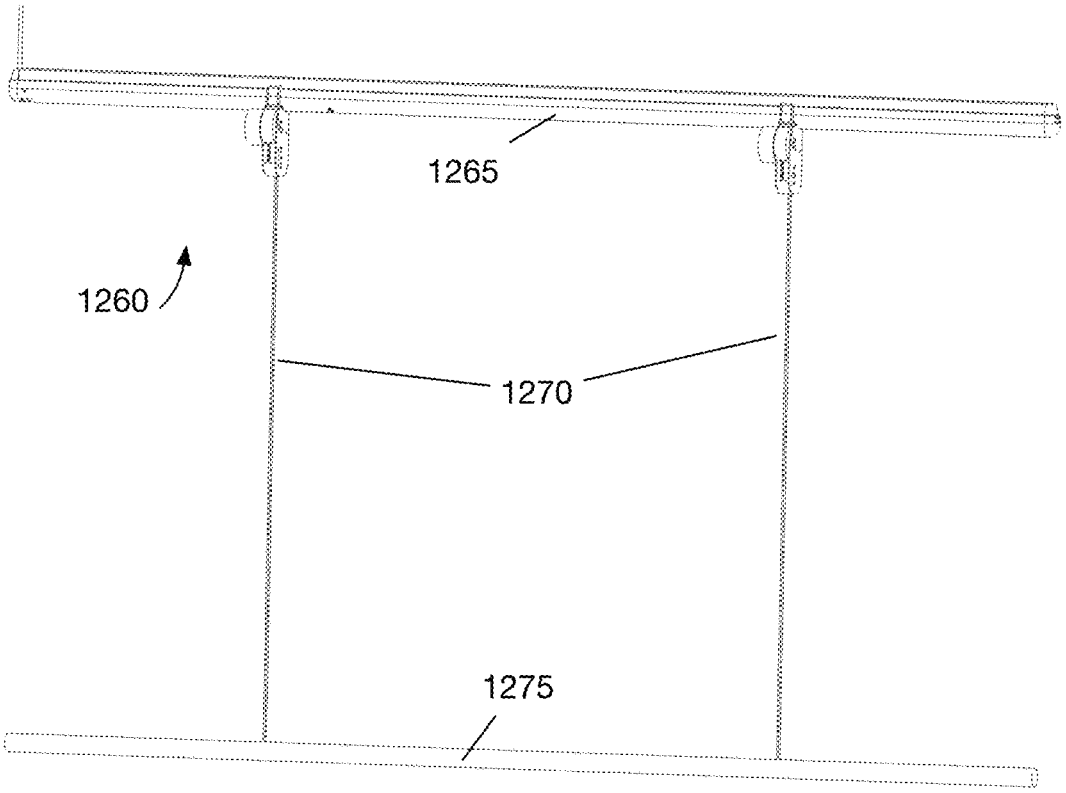
FIG. 12D illustrates an alternative installation orientation in accordance with the invention.

As described herein, a hoist in accordance with the invention may be used alone, or in combination with similar or different hoists in various arrangements. This may include independently operating hoists in various orientations, including end-to-end alignment, parallel and coordinated stacking arrangements. FIGS. 12A-C further illustrate implementations in which either a singular or multiple hoists in accordance with the invention are incorporated into additional mechanical structures. For example, FIG. 12A illustrates a triangle truss arrangement 1200 having a compact hoist 1205 incorporated into a three-sided truss 1210. FIG. 12B illustrates an inverted triangle truss arrangement 1220 incorporating two compact hoists 1225 into a three-sided truss 1230. FIG. 12C illustrates a square truss arrangement 1240 incorporating two compact hoists 1245 in to a four-sides truss 1250. FIG. 12C also illustrates a further embodiment of a diverter system 1255 in accordance with the invention. In FIGS. 12A-C, a hoist of the invention, whether formed by an extrusion process or otherwise, may be substituted for one of the plural horizontal lengths forming the respective trusses, or may be inserted into a pre-existing or additional tube of the truss. While hoists may be operated independently in embodiments incorporating more than one, it may also be desirable to coordinate control of multiple hoists electronically, such as via control systems and specialized software, for example.

Figure 12E:
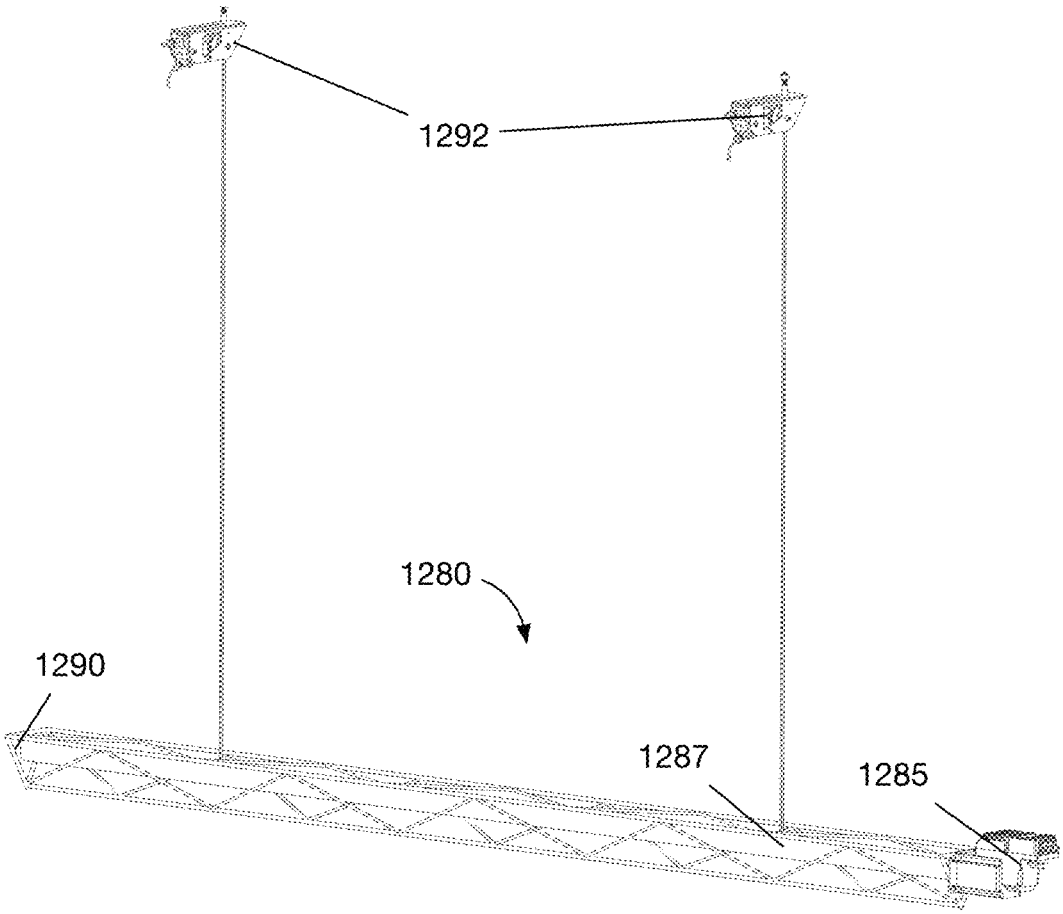
FIG. 12E illustrates an alternative embodiment of a combination system in accordance with the invention.

In addition to incorporation into other devices, a hoist alone, in accordance with the invention, may be utilized in a variety of ways. In one embodiment, shown in FIG. 12D, an inverted hoist arrangement 1260 utilizes a hoist 1265 in accordance with the invention mounted at an elevated location, such that elongate members 1270 extend downward for connection to an item to be elevated, which may be a batten 1275 as illustrated, or any other object. FIG. 12E illustrates yet another embodiment as an alternative triangle truss 1280, in which the batten of hoist 1285 represents a fourth lengthwise member within the three members that form the 3-sides triangle truss. As above, in this embodiment, a hoist 1285 may be adapted to a lengthwise tube 1287 incorporated into the trust, which may be connected to a support plate 1290 as illustrated. FIG. 12E also illustrates an implementation of load balancing trim mechanisms 1292 in accordance with the invention. FIGS. 12A-E represent exemplary embodiments of potential applications for a versatile hoist in accordance with the invention, and countless other are contemplated.

Figure 13:
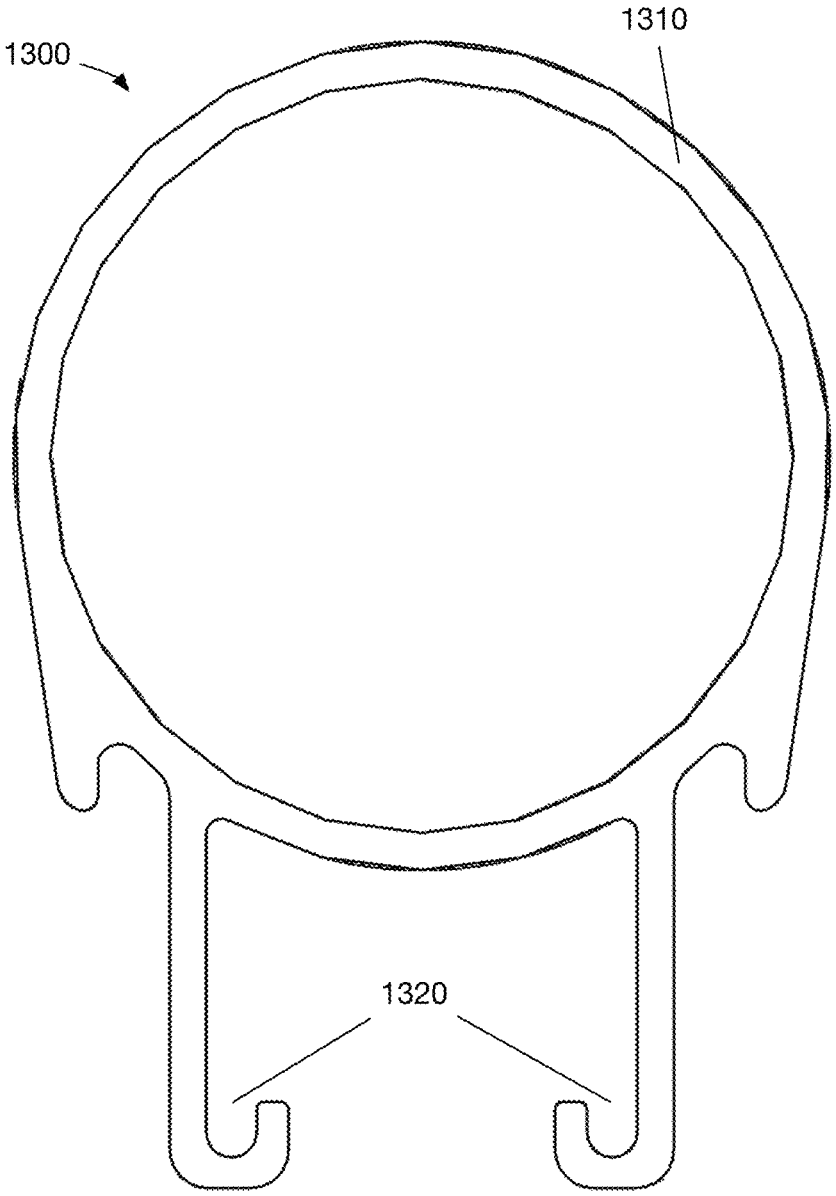
FIG. 13 illustrates an embodiment of an alternative manufactured product having an incorporated attachment mechanism, in accordance with the invention.

In varied applications, a hoist of the invention may take a variety of shapes, with cross sections ranging from cylindrical (internally and/or externally) to elliptical to polygonal, etc., or otherwise as an application warrants. In one embodiment, it may further be desirable to attach various adaptations to a body of a hoist in accordance with the invention. For example, a pipe of the invention may be fitted with connection points for attachment of theater accessories. Such connections may be made to a body of a hoist, or a pipe may be fitted with one or more accessories for facilitating attachment of additional items. There are available various implements, including a variety of channels and rails under the Unistrut® name (from Atkore International, Inc.), for example, which may be attached to a hoist, such as by bolts. In an alternative embodiment, a channel is formed at an initial manufacturing stage, for example as part of an extrusion process, among other possibilities. FIG. 13 illustrates a cross section of an exemplary embodiment of a pipe or batten 1310 of a hoist 1300 incorporating such a channel 1320 in accordance with the invention. Other embodiments may incorporate features of the Smart-Track® Lighting System (proprietary to Altman Lighting Co. Inc.) and other such systems, as appropriate to a particular implementation.

Figure 14A:
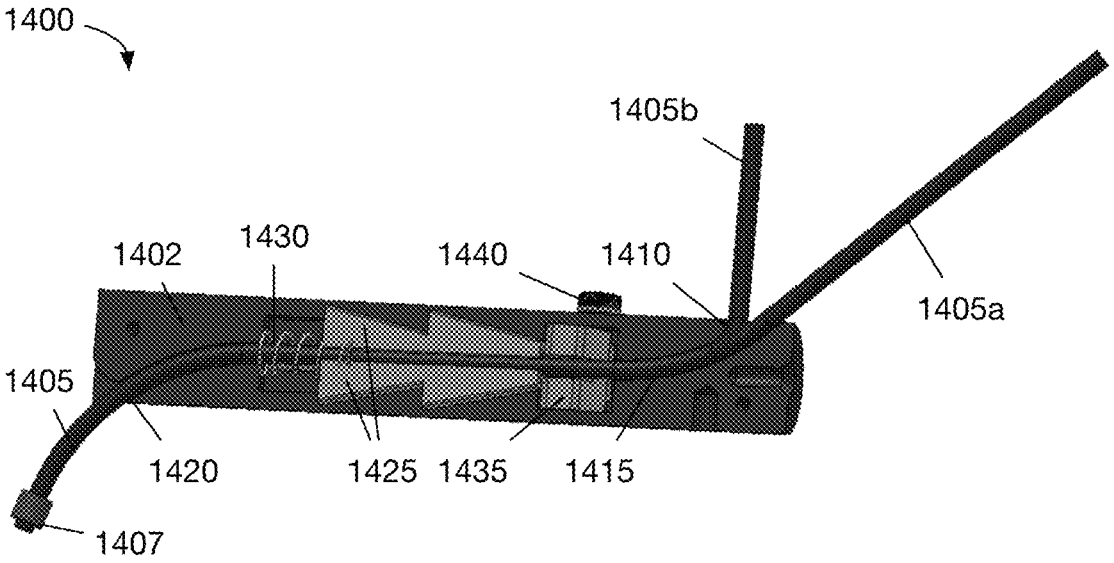
FIG. 14A illustrates an embodiment of an elongate member trim mechanism in accordance with the invention.

In another aspect of the invention, a trim mechanism is provided for adjusting an operative length of an elongate member, such as a wire rope. With reference to FIG. 14A, an embodiment of a trim mechanism 1400 is illustrated for adjusting at a batten or other moving component (not shown) of a hoist system, an operative length of a wire rope 1405 between the hoist and the moving component. For illustration purposes, a single rope is shown in two positions, a position 1405*a* during feeding into the trim mechanism 1400, and a position 1405*b* during use with a hoist. The illustrated positions 1405*a* and 1405*b* are approximate. In use, the wire rope 1405 is fed via a position 1405*a* into a body 1402 of the mechanism 1400 through an entry point 1410, along a channel 1415, and out an exit point 1420. Disposed within the channel 1415 is a pair of jaws 1425 and a spring 1430, biasing the jaws 1425 toward an engaged position.

The engaged position represents a condition in which the jaws 1425 are pushed toward each other by interior sloped walls of the body 1402 of the mechanism 1400, upon a lateral force being applied to the jaws 1425 in the direction of the force of the spring 1430, i.e. along the length of the channel 1415 toward the entry point 1410. One skilled in the art will appreciate that upon movement of an elongate member 1405 toward the exit point 1420, friction between the elongate member 1405 and the jaws 1425 will likewise bias the jaws 1425 toward the exit point 1420 and against the force of the spring 1430, allowing the jaws 1425 to separate, allowing freer movement of the elongate member 1405.

Upon reversal of a direction of travel of the elongate member 1405 through the channel 1415, friction between the elongate member 1405 and the jaws 1425 will, with further assistance by the spring 1430, bias the jaws 1425 toward each other, increasing friction upon the elongate member 1405 and, after a short distance, ultimately arrest further movement of the elongate member 1405 toward the entry point 1410. In this manner, fine adjustments may be made to an operative length of an elongate member 1405 by pulling an opposite, loose end of the elongate member 1405 through the channel 1415 toward the exit point 1420 (right to left in FIG. 14A). If the direction of movement needs to be reversed, as to release additional operative length of the elongate member 1405, a shoulder bolt 1440 or other applicable adjustment mechanism may first be turned. In the embodiment illustrated, the shoulder bolt 1440 actuates a cam 1435, which abuts the jaws 1425. Actuation of the cam 1435 acts to push the jaws 1425 toward the exit point 1420 and against the spring 1430, permitting the jaws 1425 to separate, allowing the elongate member 1405 free passage in a reverse (left to right in FIG. 14) direction as needed. A sleeve 1407 may be put at an end of the elongate member 1405 after insertion into the trim mechanism 1400 to prevent the elongate member 1405 from thereafter being removed inadvertently.

Upon release of the cam 1435 by the shoulder bolt 1440, the jaws 1425 may again operate to clamp down upon the elongate member 1405 under operation of the spring 1430 and, as applicable, movement of the elongate member 1405 in a direction from the exit point 1420 toward the entry point 1410.

Potential applications for a trim mechanism as that illustrated by FIG. 14A include for use with a batten, where the trim mechanism 1400 may be formed as to fit within the batten, such that a elongate member trimming function may be accomplished with no loss of space external to the batten, i.e., between the batten and a rope attachment point, resulting in no loss of vertical travel distance. The concepts and functionality of the trim mechanism 1400 may likewise be applied to a variety of applications without departing from the scope of the invention, potentially any hoist, counterweight system, etc.

Figure 14B:
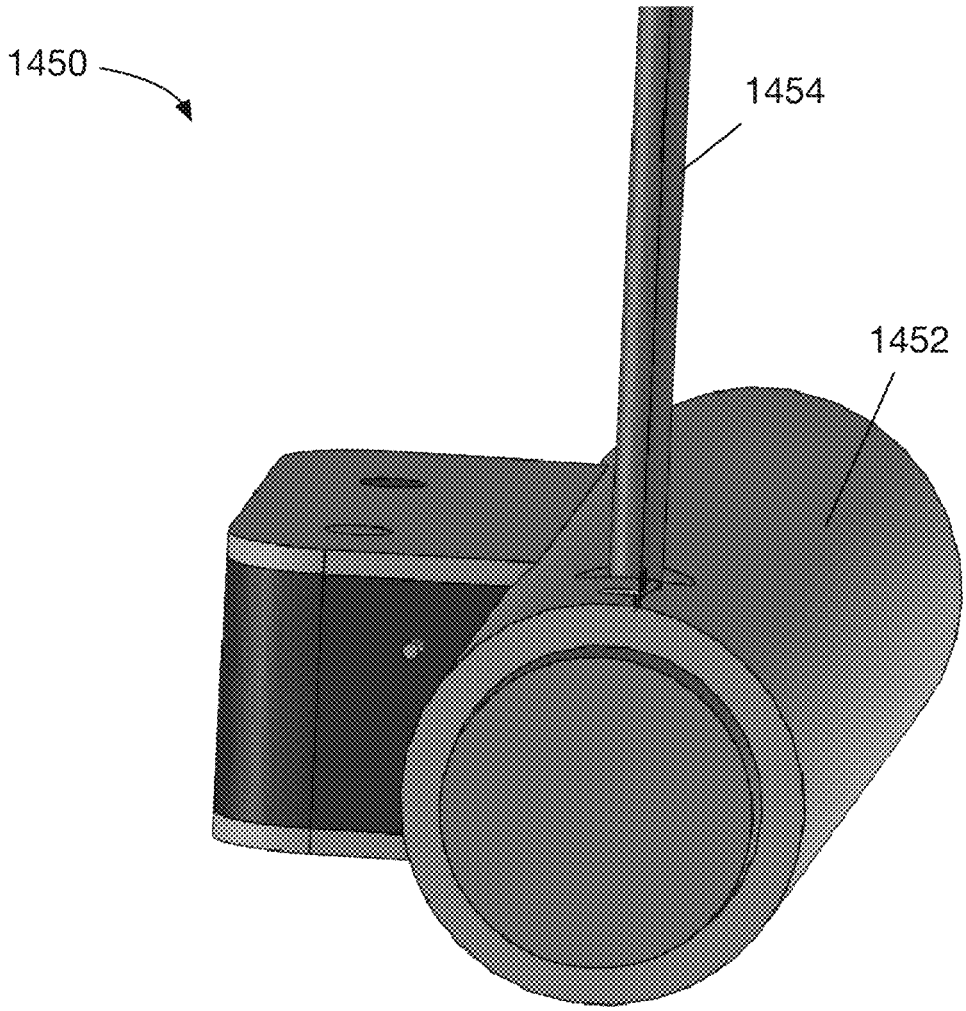
FIGS. 14B-E illustrate an alternative embodiment of an elongate member trim mechanism in accordance with the invention.
Figure 14C:
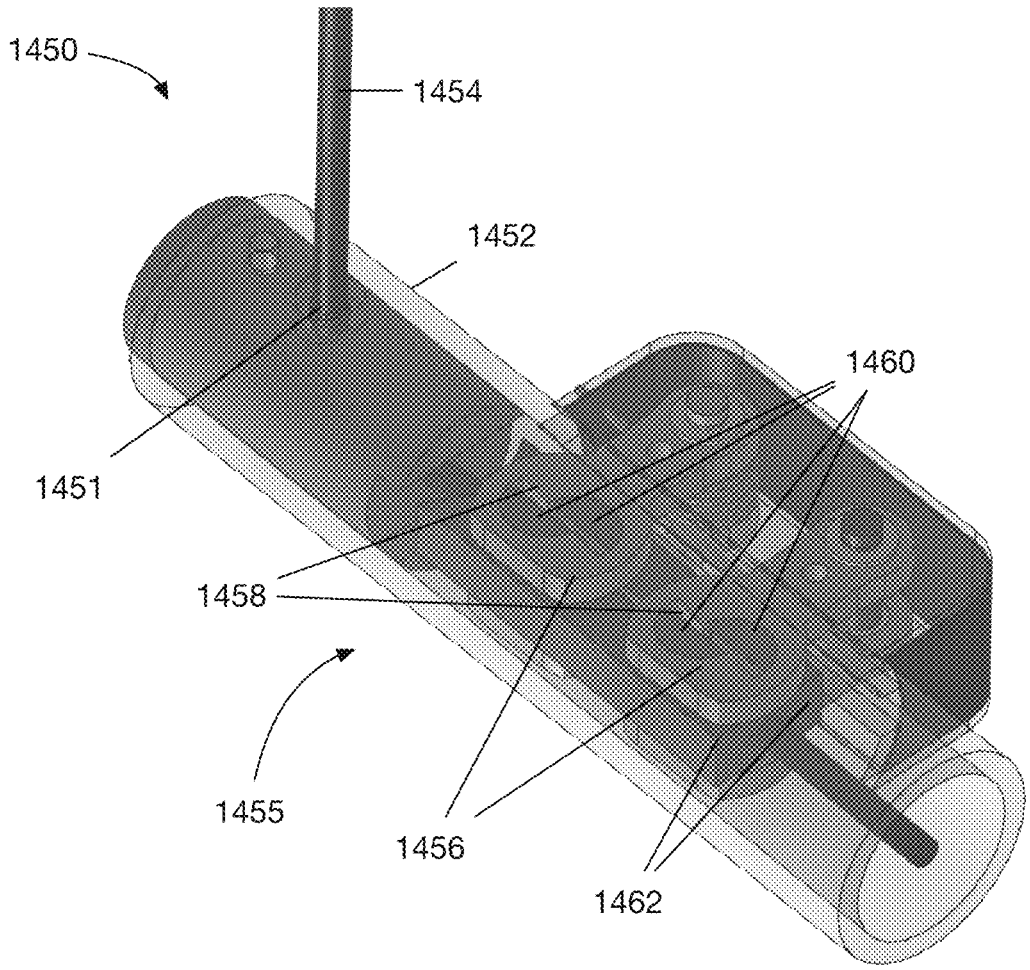

FIG. 14B illustrates an external view of an alternative embodiment of a trim mechanism 1450 that may be fitted within a batten 1452 for adjusting an operative length of an elongate member 1454. FIG. 14C reveals internal components of the trim mechanism 1450, including a locking mechanism 1455 that operates in a similar manner to the brake assembly 1150 illustrated by FIG. 11A. A pair of keys 1456 having slots 1458 formed therein that support and actuate s a pair of jaws 1462 via tabs or cogs 1460 formed on the jaws 1462.

Figure 14D:
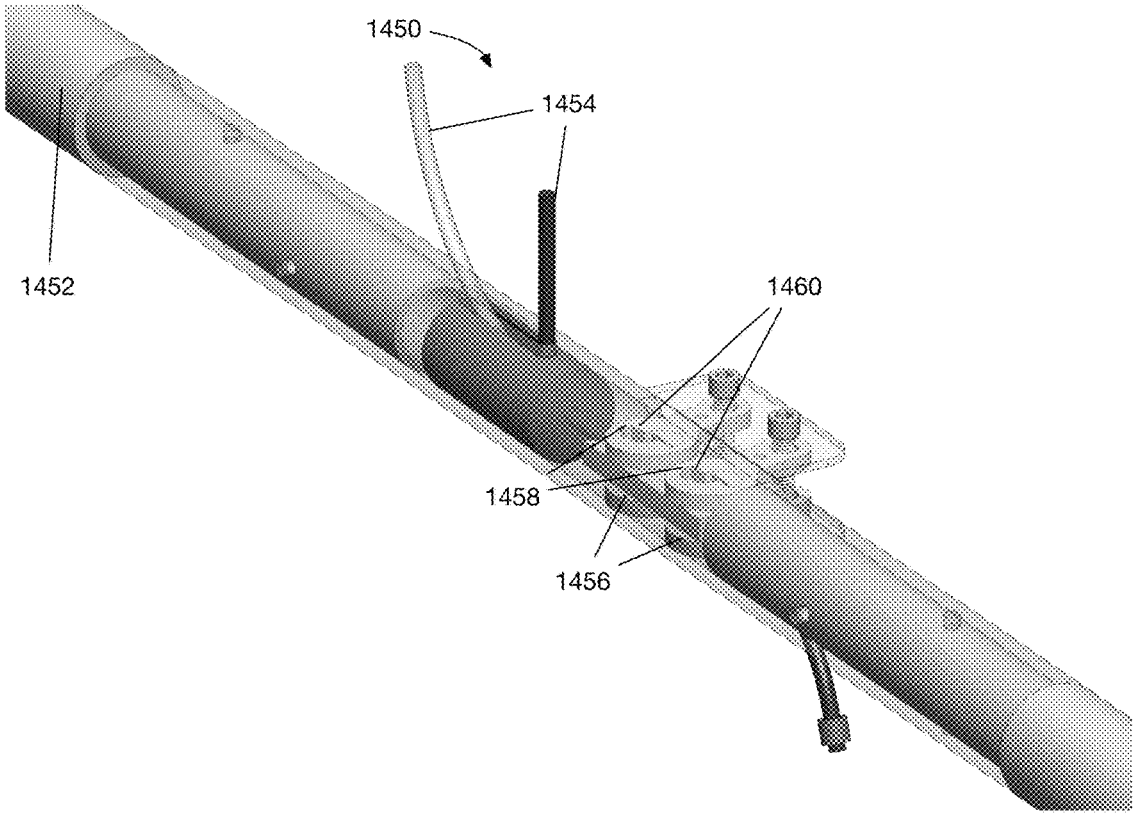
Figure 14E:
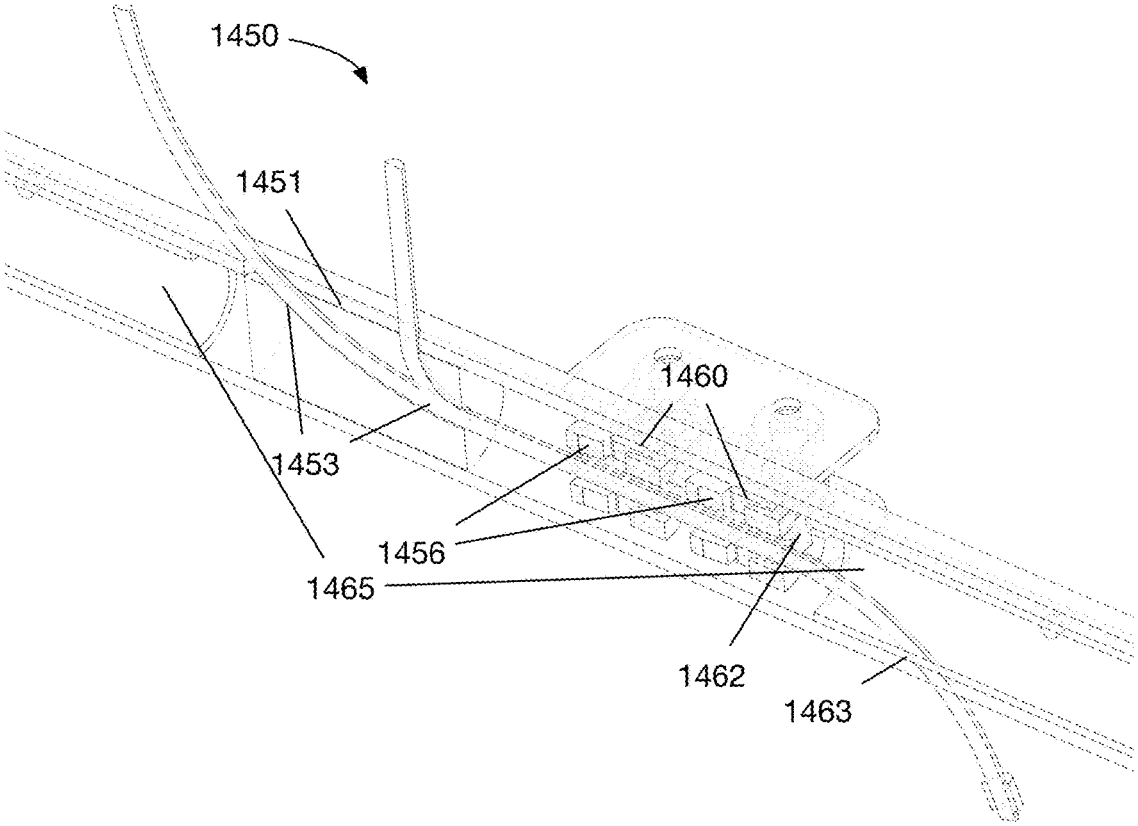

Referring specifically to FIG. 14C, at installation an elongate member 1454 is fed through an insertion hole (or slot; see FIG. 14B) 1451, through the locking mechanism 1455, into a batten 1452, and potentially through an exit hole 1463 (see FIG. 14E). A guide or groove 1453 may act to guide the elongate member 1454 (FIG. 14E) during insertion. Upon application of tension upon the elongate member 1450, the keys 1456 divert from the neutral position shown, applying pressure on the cogs 1460, which moves the paired brakes 1462 toward one other, clamping down on the elongate member 1154 passing between them. Specifically, at installation, the elongate member 1454 moves with some ease through the jaws 1462, but when the direction is reversed (to the direction imparted by a load on the batten 1452 during operation), the jaws 1462 prevent the elongate member 1454 from slipping backward. FIG. 14D shows a wider perspective view of the trim mechanism 1450, while FIG. 14E shows a cross section of the mechanism 1450, revealing additional detail of the keys (in part) 1456, one of the pair of jaws 1462 and cogs 1460. In one embodiment, the trim mechanism 1450 is formed as part of an inner sheath 1465 used to splice multiple battens 1452, or may be centered within a single such pipe; in application, wherever along a length of the pipe it is desired to attach an elongate member 1154.

Varied inventions are disclosed herein through numerous non-limiting embodiments. To further summarize to some extent, additional embodiments are provided. In one aspect, a diverter system is provided that may comprise (i.e., may include the following and/or additional features) a bracket supporting a pair of sheaves, one of which may be stepped, for diverting one or more elongate members from a substantially vertical exit from a hoist batten, substantially along a length of the batten, about a second one or more sheaves, directing the one or more elongate members substantially vertically to an overhead connection point.

In another embodiment, a load balancing trim mechanism may comprise means for connecting the same to an overhead connection point, a pair of termination points supported by a rocking bracket to which are attached a pair of independent elongate members, thereby substantially balancing a load experienced by each of the pair of elongate members.

In another embodiment, a trim mechanism is provided for use inside a pipe for trimming a wire rope without shortening the operative length thereof. The trim mechanism may comprise a pair of opposing jaws that permit the movement of a wire rope in a first direction but prevent its movement in a second direction, due to a translation of the axial force of the wire rope to increase a force applied to the wire rope by the opposing jaws. This translation may be effected specially shaped keys that cooperate with cogs formed in the surface of the jaws. The means for permitting and precluding as desired, motion of an elongate member, depending upon its direction, may be applied as well to an overspeed brake, as described herein.

In another aspect, a method of terminating a wire rope is providing, comprising feeding the wire rope through a first hole in a drum, out a second hole in the drum, applying a clamping device at the end of the rope that permits passage of the end through the second hole but not the first hole, thereby terminating the rope within the drum while providing an efficient and manageable mechanism for accomplishing the same.

In another aspect, a means for stabilizing a length of drum shaft is provided, comprising a bearing adapted to be connected at either end of a drum supported by the drive shaft, the bearing attaching to the drum shaft and being fitted with a housing that cooperates with an inner surface of a pipe containing the drum and drum shaft, the housing translating but not rotating with respect to the pipe during operation.

In another aspect, the invention includes a variety of combination truss systems, comprising a hoist in accordance with the invention in combination with a mechanical truss, which may comprise a number of lengths of a durable material coupled by shorter length of support structure. The hoist may be substituted for a length of material in a standard truss arrangement, or may be fitted in an added support structure, such as a pipe. Multiple hoists may be adapted for use in a single combination structure.

In another aspect, the invention provides an extruded hoist enclosure that combines a hoist enclosure with any of a variety of additional structure, including brackets, rails and other implements that may facilitate connection of additional objects to be hoisted during use.

While the description herein may refer to specific reference numbers in the figures, the description is likewise applicable to analogous elements having different numbers. For example, descriptions of features of a drum 220 may likewise apply to others such as drums 320*a* and 320*b*, etc.; descriptions of features of a latch 1052 may likewise apply to a lever 1140, etc.; and components such as a drum 220 may be used with any other features, although they might only be disclosed herein with respect to another embodiment.

As noted above, battens are only one embodiment of an enclosure in accordance with the invention. The concepts of the invention may have applicability to other structures/enclosures, etc. as well, and numerous additional applications are further contemplated. For example, the inventions have been described primarily with respect to an enclosure that takes the form of a tubular structure, e.g., a circular, elliptical or otherwise rounded structure. As will be clear to one skilled in the art from the disclosure, however, other shapes, including square, rectangular and other polygonal and other shapes as well, depending upon a desired application. Nor is the invention limited to any particular material or structural framework. The concepts, methods and apparatus disclosed may be used in countless other applications not expressly mentioned herein without departing from the scope and spirit of the invention.

The inventions have been described for connection to an overhead support for lifting objects vertically, primarily in performance-type environments. Other implementations are contemplated, however, such as for pulling up an incline, and dragging/towing an object across a horizontal surface, among others, as well as in a variety of other venues and outdoors. An embodiment is also contemplated in which a vertical orientation of a hoist in accordance with the invention is substantially reversed, such that batten is mounted in an elevated position with elongate members extending outwardly therefrom, for attachment to an object to be lifted or moved.

A means for causing translation of a drum due to rotational motion is described herein by way of example as a rod having acme threading, but variations are contemplated. A variety of threading techniques are known, and the threads need not be trapezoidal in cross section and/or formed at any particular angle or pitch. Nor must a threaded rod be used at all where other drive means are available.

The inventions have been described in the context of a system whose primary mechanics (motors, drums, drive features, etc.) may be enclosed within a batten or other support enclosure. The system, however, might further include external features as described, including elongate members, mechanism for attachment to an elevated support, pulleys, sheave assembly, etc. In addition, various primary features might be disposed externally, depending upon a nature of the enclosure used and the application environment. Many features as well have been described as sharing a center axis, but a departure from this is likewise contemplated, as described herein. Furthermore, while the invention has often been described generally in the context of a smaller, more compact system, the concepts herein are applicable and scalable to much larger-scale operations as well.

As described herein, positional references and terms of orientation, such as overhead, elevated, above, below, horizontal, vertical, etc., herein assume a certain orientation of the described apparatus, are not intended to dictate precise angles or positions, and may be reversed or otherwise varied, depending upon the relative locations and orientations of the items involved. Furthermore, references to a clock dial have been used herein, i.e., positions such as 3:00, 9:00, 12:00, etc., where, when viewing a cross section of an enclosure in its operative orientation, vertically below an overhead support (in an embodiment where an overhead support is applicable), 12:00 indicates a direction directly vertical upward to the overhead support, 3:00 and 9:00 indicate directions to the right and left, respectively, at 90 degree angles to a vertical direction, in a plane perpendicular to a length of the enclosure. One skilled in the art will recognize that these references are approximate and that, given the effectively limited number of potential options in a 360 degree circle, all possible orientations are expressly contemplated depending upon a particular application, absent highly unexpected results owing to a highly specific orientation.

In describing the inventions, various articles may be described as coupling or being coupled, connecting or being connected, attached, etc., to one another. This phraseology is not intended to exclude potential intermediate parts, i.e., coupling and connecting may be direct or indirect, unless otherwise limited.

What is claimed is:

1. An overspeed brake assembly for use in a hoist system utilizing an elongate member, comprising:

a rotary device coupled to the elongate member;

a centrifugal member coupled to the rotary device and being adapted to move from an inactive position to an active position when a rotational speed of the rotary device exceeds a predetermined limit;

a trip mechanism disposed in proximity to the rotary device, such that the rotary device in the inactive position may rotate freely of the trip mechanism, and such that the rotary device, upon rotation in the active position, actuates the trip mechanism;

a brake assembly coupled to the trip mechanism, the brake assembly comprising:

a key having formed therein a guide for receiving a jaw, the key being movable between a 1) disengaged position wherein the jaw is positioned in proximity to the elongate member and 2) an engaged position wherein the jaw is moved into contact with the elongate member, applying a braking force thereto;

a spring positioned to bias the key toward the engaged position;

a release, coupled to the trip mechanism, for maintaining the key in the disengaged position until the release is tripped by the trip mechanism.

2. The overspeed brake assembly of claim 1, wherein the rotary device comprises a wheel.

3. The overspeed brake assembly of claim 1, wherein the rotary device is connected so as to be in direct contact with the elongate member.

4. The overspeed brake assembly of claim 1, wherein the rotary device is coupled to the elongate member through a shaft and pulley arrangement.

5. The overspeed brake assembly of claim 1, wherein the centrifugal member comprises a dog and the rotary device comprises an inner link connected to an outer link by a rotatable pivot, the dog being slideably coupled to the outer link such that the dog is permitted to move from the inactive position to the active position upon rotation of the rotary device.

6. The overspeed brake assembly of claim 5, further comprising:

a first end of the inner link connected to a first end of the centrifugal member and a second end of the inner link connected to a first end of a second centrifugal member;

a first end of the outer link connected to a second end of the centrifugal member and a second end of the outer link connected to a second end of the second centrifugal member.

7. The overspeed brake assembly of claim 1, wherein the release comprises a bar in contact with a latch formed in the key.

8. The overspeed brake assembly of claim 7, the trip mechanism comprising a lever for tripping the bar, wherein the lever is coupled to the bar by a linkage mechanism.

9. The overspeed brake assembly of claim 1, the key having formed therein 1) a semicircular cutout for receiving the jaw, and 2) a pivot point about which the key rotates through an arc.

10. The overspeed brake assembly of claim 1, wherein the predetermined limit corresponds to a predetermined rate of movement of the elongate member, as determined via the coupling between the elongate member and the rotary device.

11. An overspeed brake assembly for use in a hoist system, the hoist system including an elongate member adapted to lift an article between a lowered position to a raised position, the overspeed brake assembly comprising:

an overspeed detection portion configured to be in communication with the elongate member to detect a velocity of the elongate member; and a braking portion in communication with the overspeed detection portion, the braking portion including a clamp moveable in a first position in which the clamp is configured to allow movement of the elongate member relative to the clamp, the clamp also moveable in a second position in which the clamp is configured to engage the elongate member to inhibit movement of the elongate member relative to the clamp in response to the overspeed detection portion detecting an overspeed condition of the elongate member;

wherein the clamp is biased into the second position from the first position; and wherein the braking portion includes an arm pivotable about an axis and coupled to the clamp, and wherein the clamp is moveable between the first and second positions in response to movement of the arm about the axis; and wherein a spring is coupled to the arm to bias the clamp into the second position.

12. The overspeed brake assembly of claim 11, wherein the clamp includes a pair of jaws with each jaw having a groove configured to receive a portion of the elongate member when the clamp is in the second position.

13. An overspeed brake assembly for use in a hoist system, the hoist system including an elongate member adapted to lift an article between a lowered position to a raised position, the overspeed brake assembly comprising:

an overspeed detection portion configured to be in communication with the elongate member to detect a velocity of the elongate member, and a braking portion in communication with the overspeed detection portion, the braking portion including a clamp moveable in a first position in which the clamp is configured to allow movement of the elongate member relative to the clamp, the clamp also moveable in a second position in which the clamp is configured to engage the elongate member to inhibit movement of the elongate member relative to the clamp in response to the overspeed detection portion detecting an overspeed condition of the elongate member;

wherein the clamp is biased into the second position from the first position; and wherein the braking portion includes an arm pivotable about an axis and coupled to the clamp, and wherein the clamp is moveable between the first and second positions in response to movement of the arm about the axis; and wherein the braking portion includes a latch engageable with a protrusion of the arm to hold the clamp in the first position, and wherein the latch is disengageable with the protrusion allowing the clamp to move into the second position.

14. An overspeed brake assembly for use in a hoist system, the hoist system including an elongate member adapted to lift comprising:

an overspeed detection portion configured to be in communication with the elongate member to detect a velocity of the elongate member; and a braking portion in communication with the overspeed detection portion, the braking portion including a clamp moveable in a first position in which the clamp is configured to allow movement of the elongate member relative to the clamp, the clamp also moveable in a second position in which the clamp is configured to engage the elongate member to inhibit movement of the elongate member relative to the clamp in response to the overspeed detection portion detecting an overspeed condition of the elongate member;

wherein the braking portion includes a housing supporting the clamp, wherein the housing is coupled to a fixed carriage assembly by a dampening mechanism such that the housing is moveable relative to the fixed carriage assembly, and wherein the dampening mechanism is configured to dampen movement of the housing relative to the fixed carriage assembly when the clamp moves into the second position.

15. The overspeed brake assembly of claim 11, wherein the overspeed detection portion is rotatable about an axis, wherein the clamp moves into the second position in response to the overspeed detection portion reaching a predefined angular velocity about the axis.

16. A hoist system comprising:

a drum operable to rotate about a rotational axis;

an elongate member wound about the drum, the elongate member configured to move an article between a raised position and a lowered position in response to the drum moving about the rotational axis; and an overspeed brake assembly including an overspeed detection portion in communication with the elongate member to detect a velocity of the elongate member, and a braking portion in communication with the overspeed detection portion, the braking portion including a clamp moveable to a first position in which the clamp allows movement of the elongate member relative to the clamp, the clamp moveable to a second position in which the clamp engages the elongate member to inhibit movement of the elongate member relative to the clamp in response to the overspeed detection portion detecting an overspeed condition of the elongate member.

17. The hoist system of claim 16, wherein the overspeed detection portion includes a roller rotatable about a second axis, wherein the roller is engageable with the elongate member such that movement of the article between the raised position and the lowered position rotates the roller about the second axis to detect the velocity of the elongate member.

18. The hoist system of claim 17, wherein the elongate member is a first elongate member, and wherein the roller is configured to engage a plurality of elongate members.

19. The hoist system of claim 18, wherein the braking portion includes a plurality of clamps with each clamp configured to engage one of the plurality of elongate members in response to the overspeed detection portion detecting the overspeed condition.

20. The hoist system of claim 16, wherein the braking portion includes an arm pivotable about an axis and coupled to the clamp, wherein the clamp is moveable between the first and second positions in response to movement of the arm about the axis, and wherein a biasing member is coupled to the arm to bias the clamp into the second position.

* * * * *